US007357697B2

(12) United States Patent
Massa et al.

(10) Patent No.: US 7,357,697 B2
(45) Date of Patent: Apr. 15, 2008

(54) SUPERHARD MATERIAL ARTICLE OF MANUFACTURE

(75) Inventors: Ted R. Massa, Latrobe, PA (US); John J. Prizzi, Greensburg, PA (US); David R. Siddle, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 282 days.

(21) Appl. No.: 10/154,654

(22) Filed: May 24, 2002

(65) Prior Publication Data

US 2002/0173250 A1 Nov. 21, 2002

Related U.S. Application Data

(60) Division of application No. 09/559,745, filed on Apr. 27, 2000, now Pat. No. 6,425,805, which is a continuation-in-part of application No. 09/316,786, filed on May 21, 1999, now abandoned.

(51) Int. Cl.
*B24B 1/00* (2006.01)

(52) U.S. Cl. ..... 451/102; 29/428

(58) Field of Classification Search ..... 451/102, 451/91, 90, 40; 29/447, 463, 890, 143, 428, 29/890.143; 222/16, 17, 19; 239/433, 600, 239/390, 427, DIG. 19; 175/397, 424
See application file for complete search history.

(56) References Cited

U.S. PATENT DOCUMENTS 2,332,407 A * 10/1943 Spenle ..... 451/90
4,112,568 A 9/1978 Hale
4,428,906 A 1/1984 Rozmus
4,545,157 A 10/1985 Saurwein
4,547,337 A 10/1985 Rozmus
4,555,872 A 12/1985 Yie
4,587,772 A * 5/1986 Griffiths ..... 451/102
4,600,149 A 7/1986 Wakatsuki
4,648,215 A 3/1987 Hashish et al.
4,744,943 A 5/1988 Timm
4,765,540 A 8/1988 Yie ..... 239/8

(Continued)

FOREIGN PATENT DOCUMENTS

DE 19640920 1/1998

(Continued)

OTHER PUBLICATIONS

Wire Drawing Die GB Patent No. 1466312 , Mar. 1977, Wentorf et al.*

(Continued)

*Primary Examiner*—Jacob K. Ackun, Jr.
(74) *Attorney, Agent, or Firm*—John J. Prizzi

(57) ABSTRACT

The invention relates to abrasive water jet systems comprising an abrasive water jet mixing tube having a longitudinal bore lined with a superhard material, including such systems which use cubic boron carbide (CBN), diamond, or other materials with a hardness greater than that of alumina as the abrasive material. The invention also comprises methods of using an AWJ system having a mixing tube having a longitudinal bore lined with a superhard material. Some embodiments include AWJ mixing tubes comprised of a plurality of connected components. Such connections may be disconnectable.

11 Claims, 13 Drawing Sheets

U.S. PATENT DOCUMENTS

| | | | | | |
|---|---|---|---|---|---|
| 4,768,709 | A | | 9/1988 | Yie | 239/8 |
| 4,920,841 | A | * | 5/1990 | Johnson | 83/177 |
| 4,923,512 | A | | 5/1990 | Timm et al. | 75/239 |
| 4,945,073 | A | | 7/1990 | Dubensky et al. | 501/93 |
| 4,951,429 | A | | 8/1990 | Hashish et al. | 51/439 |
| 5,033,681 | A | | 7/1991 | Munoz | 239/596 |
| 5,092,085 | A | | 3/1992 | Hashish et al. | 51/439 |
| 5,156,725 | A | | 10/1992 | Doktycz et al. | 204/192.16 |
| 5,199,512 | A | | 4/1993 | Curlett | 175/67 |
| 5,232,522 | A | | 8/1993 | Doktycz et al. | 148/218 |
| 5,256,608 | A | | 10/1993 | Dubensky et al. | 501/94 |
| 5,334,561 | A | | 8/1994 | Matsui et al. | |
| 5,363,556 | A | | 11/1994 | Banholzer et al. | 29/890 |
| 5,373,993 | A | * | 12/1994 | Flynn et al. | 239/591 |
| 5,374,392 | A | | 12/1994 | Skelcey et al. | |
| 5,385,205 | A | * | 1/1995 | Hailey | 166/55.8 |
| 5,407,503 | A | * | 4/1995 | Matsui et al. | 156/89.25 |
| 5,434,112 | A | | 7/1995 | Matsui et al. | |
| 5,439,492 | A | * | 8/1995 | Anthony et al. | 51/295 |
| 5,523,121 | A | | 6/1996 | Anthony et al. | 427/249 |
| 5,542,486 | A | * | 8/1996 | Curlett | 175/424 |
| 5,563,107 | A | | 10/1996 | Dubensky et al. | |
| 5,611,649 | A | * | 3/1997 | Matthias | 407/118 |
| 5,612,264 | A | | 3/1997 | Nilsson et al. | |
| 5,626,508 | A | | 5/1997 | Rankin et al. | |
| 5,641,921 | A | | 6/1997 | Dennis et al. | |
| 5,681,783 | A | | 10/1997 | Nilsson et al. | |
| 5,785,582 | A | | 7/1998 | Stefanik et al. | 451/102 |
| 5,794,858 | A | * | 8/1998 | Munoz | 239/433 |
| 5,851,139 | A | | 12/1998 | Xu | |
| 5,869,133 | A | * | 2/1999 | Anthony et al. | 427/249.8 |
| 6,302,224 | B1 | * | 10/2001 | Sherwood, Jr. | 175/397 |
| 6,447,852 | B1 | * | 9/2002 | Gordeev et al. | 427/577 |

FOREIGN PATENT DOCUMENTS

| | | | | |
|---|---|---|---|---|
| EP | 0442303 | | 8/1991 | |
| EP | 0721801 | | 7/1996 | |
| JP | 63-50700 | | 4/1988 | |
| JP | 63-315597 | | 12/1988 | |
| JP | 1-138110 | | 5/1989 | |
| JP | 405277947 | | 10/1993 | |
| JP | 2-35680 | * | 9/1994 | 451/34 |
| JP | HEI6-34936 | | 9/1994 | |
| JP | 10006222 A | | 1/1998 | |
| WO | WO9815386 | | 4/1998 | |

OTHER PUBLICATIONS

Burnham, Chip, "Abrasive Waterjets Come of Age," Machine Design, a Penton Publication, 1990 (reprint).

Omax Corporation—Omax Jet Machining™ Center Brochure, 1994.

Omax Corporation, www.omax.com, Apr. 1999 (document from Internet).

AB Best Matic, Part of worldwide Ingersoll-Rand, Waterjet Cutting Systems brochure (undated).

Flow International Corporation—Paser™ II Abrasive Waterjet Systems, brochure, 1992.

Flow International Corporation—Flow Facts, Datasheet, 1992.

Flow International Corporation, "Abrasivejets Offer Superior Shape Cutting Ability," Datasheet, 1992.

Flow International Corporation, "Waterjet Systems." Brochure, 1995.

Flow International Corporation, "Abrasivejet Helps Keep Aerospace Parts Manufacturing Flying," Datasheet, Dec. 1989.

Holmes, J., "Abrasive Waterjet Nozzle," engineering drawing 1555140 Rev. 08, Boride Products, Traverse City Michigan, Dec. 1988.

Kester, Raymond L., "Polycrystalline Diamond Tooling," Cutting Tool Materials in Applications Conference, Mar. 1987, Society of Manufacturing Engineers, 1987, pp. MR87-230-2 through MR87-230-10.

Hashish, M., "Mixing Tube Material Effects and Wear Patterns," 9th American Waterjet Conference, Aug. 23-26, 1997 (page numbers unknown).

Nanduri, M. et al., "Wear Patterns in Abrasive Waterjet Nozzles," Jetting Technology, BHR Group, 1996, pp. 27-43.

Liu, Y. H. et al., "Electric Discharge Milling of Polycrystalline Diamond," Proceedings of the Institution of Mechanical Engineers, Part B: General of Engineering Manufacture, vol. 211, No. B8, 1997, p. 643-647.

Wyss, R. and E. Pollak, "Machining Concept for PCD Tools," Industrial Diamond Review, vol. 51, No. 547, Jun. 1991, p. 280-283.

Spur, G. et al., "Wire EDM of PCD," Industrial Diamond Review, vol. 48, No. 529, Jun. 1988, p. 264-266.

Stevens, Travis L., Novel Design of an Abrasive Water Jet Mixing Tube, A Thesis, University of Washington, 1997, pp. 1-100.

PCT Search Report Mailed Aug. 9, 2000.

* cited by examiner

SUPERHARD MATERIAL ARTICLE OF MANUFACTURE

CROSS-REFERENCE TO RELATED APPLICATION

This application is a divisional application of application Ser. No. 09/559,745, filed on Apr. 27, 2000, now U.S. Pat. No. 6,425,805, which is a continuation-in-part of application Ser. No. 09/316,786 filed May 21, 1999 and now abandoned.

FIELD OF THE INVENTION

The present invention relates to superhard articles of manufacture for use in many applications but preferably for use as mixing tubes for use in high-pressure abrasive water jet systems and methods for producing same. More particularly, the invention relates to mixing tubes using a superhard material, i.e. PCD (polycrystalline diamond) or electrically conductive PCBN(polycrystalline cubic boron nitride), in high pressure abrasive water jet systems and methods for producing same. The present invention also relates to abrasive water jet systems comprising an abrasive water jet mixing tube having a longitudinal bore lined with a superhard material.

BACKGROUND OF THE INVENTION

High pressure abrasive water jet (AWJ) machining utilizes a very narrow stream of high pressure water laden with abrasive particles to erosion cut through a workpiece. AWJ machining is used in many industries, including the automobile, aerospace, computer, and glass industries, to create precision parts from a wide variety of materials such as plastics, metals, glass, composites, and ceramics, including those materials which are otherwise difficult to machine. The AWJ process machines with high precision, very little kerf, and produces a clean, smooth edge thereby reducing or eliminating the need for costly post-machining edge treatment operations. Because AWJ machining is a low temperature operation, it produces no heat affected zone in the machined part and can be used to machine heat treated parts without disturbing their heat treatment-induced material properties. AWJ machining heads may be guided by hand, machine, or computer with the most precise machining being obtained by computer-control of the AWJ machining head motion.

In a typical AWJ system, an intensifier pump is used to pressurize filtered water to the range of about 2,000 to 100,000 psi (14 to 690 MPa). The high pressure water is fed into an AWJ machining head where it is forced to pass through a nozzle orifice diameter as small as a few thousands of an inch (a few hundredths of a millimeter) to generate a high-velocity water jet. In commercial applications, abrasive particles such as garnet or olivine are introduced into the high-velocity water jet as it passes through a mixing chamber within the AWJ machining head. The abrasive particles and the high-velocity water jet mix as they travel together through the small diameter longitudinal bore of a mixing tube in the AWJ machining head to form upon exiting the mixing tube a narrow, abrasive, high-velocity water jet that is capable of making precise cuts through almost any kind of material.

An AWJ mixing tube longitudinal bore is subjected to severe jetting abrasion from the high-velocity water jet and abrasive particles it carries. However, the precision and the efficiency of AWJ machining is greatly affected by wear of the longitudinal bore of the mixing tube. Although the longitudinal bore diameters generally are on the order of 0.010 to 0.060 inches (0.25 to 1.5 mm) and the overall lengths of AWJ mixing tubes are usually on the order of 2 to 4 inches (5 to 10 cm), longitudinal bore diameter erosion of just a few thousands of an inch (a few hundredths of a millimeter) can greatly reduce the machining efficiency and degrade the machining precision, especially when the longitudinal bore erosion is near the exit end of the mixing tube. AWJ mixing tube longitudinal bore wear results in longer machining times, less precise machining, down time for replacing the worn mixing tube, and the cost of the replacement mixing tubes. To minimize this problem, AWJ mixing tubes are commonly made of a very hard materials, such as tungsten carbide.

In the past, there have been efforts to improve the wear resistance of AWJ mixing tubes by using chemically vapor-deposited (CVD) diamond as a longitudinal bore lining material. Diamond is an allotrope of carbon exhibiting a crystallographic network comprising covalently bonded, aliphatic $sp^3$ hybridized carbon atoms arranged tetrahedrally with a uniform distance of 1.545 Å (0.1545 nm) between atoms and is extremely hard, having a Mohs hardness of 10. For example, Banholzer et al, U.S. Pat. No. 5,363,556, estimates that the use of diamond can extend the useful lifetime of AWJ mixing tubes from the about two to four hours obtained for conventional tungsten carbide mixing tubes to about twenty to one hundred hours.

Banholzer et al., supra, describes a method of making a AWJ mixing tube by depositing a diamond layer by CVD on a funnel shaped support member to form an inner member of diamond, separating the inner member from the support member, depositing an outer member material having a higher coefficient of thermal expansion than diamond on an outer side of the inner member to form an outer member of the mixing tube, and cooling the mixing tube co contract the outer member for inducing compressive stresses of sufficient strength on the inner member to substantially prevent the formation of cracks in the inner member. Anthony et al, U.S. Pat. No. 5,439,492, describes making a AWJ mixing tube by depositing a layer of diamond by CVD on a mandrel followed by removing the mandrel mechanically or by chemical etching to form the longitudinal bore of the mixing tube and then, optionally, providing a steel tube to support the diamond film. Stefanick et al., U.S. Pat. No. 5,785,582, describes depositing a layer of diamond by CVD on opposing sides of the longitudinal bore of a AWJ mixing tube made of a hard ceramic material that has been split longitudinally and then joining the two halves of the mixing tube together by shrink fitting a metal sheath around them.

There also have been efforts to use other forms of diamond and materials having hardnesses approximating that of diamond. Japanese Utility Model Application Laid-Open No. 63-50700, describes an AWJ mixing tube comprising a plurality of dies built in a sleeve main body. Each die consists of a knob of a polycrystalline sintered body of diamond or cubic crystal boron nitride, or the like, which is fixed to the inner circumference of an annular supporting stand metal of a tough material such as a super-hard alloy, high-speed steel, or the like. Each knob has a through-hole. However, the AWJ mixing tube described above has the disadvantage that wear occurs preferentially at the junction areas between the dies (see Examined Japanese Utility Model HEI-6-34936).

SUMMARY OF THE INVENTION

The inventors of the present invention have developed a method of producing an AWJ mixing tube with a longitudinal bore lined with a superhard material which does not require the use of diamond deposited by CVD. The present invention comprises methods for making an AWJ mixing tube using one or more pieces of a superhard material. The term "superhard material" as used herein refers to polycrystalline diamond (PCD) or polycrystalline cubic boron nitride (PCBN) which can be machined by electrical discharge machining (EDM). PCD is a particular species of synthetic diamond. PCD is produced by sintering together many individual diamond crystals in the presence of a catalyst at high temperatures and pressures into a coherent mass of interbonded diamond crystals. The catalyst may be provided in the form of a powder intermixed with the diamond crystals or it may be included in an adjacent element from which it infiltrates through the spaces between the diamond crystals during the sintering process. For example, one way the catalyst can be provided is by placing diamond grit on a substrate comprising a cemented tungsten carbide having 5-20 weight percent binder of cobalt or cobalt-nickel and then subjecting these components to high temperatures and pressures so that a portion of the binder of the cemented tungsten carbide infiltrates the diamond grit and catalyzes diamond to diamond bonding. Some of the binder (e.g. cobalt or cobalt-nickel) is left in the PCD.

PCBN, which is sufficiently electrically conductive to be EDM machined, may be used in the present invention as a superhard material for lining in the AWJ mixing tube longitudinal bore. PCBN may be produced in a manner similar to that used for producing PCD.

A particular advantage of PCD over other types of diamond is its ability co be machined by EDM due to its electrically conductive metallic content. The present invention takes advantage of this characteristic and comprises a method of producing an AWJ mixing tube having a longitudinal bore lined with a superhard material, the method comprising the steps of providing at least one superhard material body and then EDM machining the at least one superhard material body to form the longitudinal bore of the AWJ mixing tube. Preferably, the present invention includes providing the longitudinal bore with a tapered entryway by EDM machining so as to facilitate the entry of the high velocity water jet and the abrasive grit into the AWJ mixing tube longitudinal bore. Also according to the present invention, any necessary machining of the external dimensions of the superhard material-cored AWJ mixing tube such as, for example, to permit the mixing tube to fit into an AWJ machining head or to provide desirable external features such as an exit end taper, is done prior to, concurrently with or subsequent to the machining of the mixing tube longitudinal bore.

As used herein, the "flow passage" of an AWJ mixing tube is the conduit which extends from one end of the mixing tube to the other through which the high velocity water jet and abrasive grit enter, travel through, and exit the mixing tube. The flow passage includes a longitudinal bore and may also include a tapered entryway. However, when the term "flow passage" is used in describing a single component of an AWJ mixing tube, the term refers to the conduit that extends from one end of the component to the other through which the high velocity water jet and abrasive grit enter, travel through, and exit the component. As used herein, the term "component" refers to a discrete, hollow segment comprising a portion of the length of an AWJ mixing tube; components are connected together to form a multi-component AWJ mixing tube.

As used herein, the term "flow-through direction" is the direction the high velocity water jet and abrasive grit travel through the AWJ mixing tube.

The present invention includes AWJ mixing tubes having a superhard material lining at least part of the AWJ mixing tube's flow passage. Such AWJ mixing tubes comprise a superhard material lining at least a part of at least one of the tapered entryway and the longitudinal bore of the AWJ mixing tube. In some embodiments, a superhard material lines the entire length of the longitudinal bore and/or the tapered entryway. In other embodiments, a superhard material lines only part of the longitudinal bore length and/or the tapered entryway while the rest of the longitudinal bore length and/or tapered entryway is lined with another type of abrasion-resistant material. The part or parts of the flow passage of the AWJ mixing tube which are to be lined with superhard material rather than some other type of abrasion-resistant material are those part or parts which the user of the AWJ mixing tube desires most to protect from erosion during use.

Although the present invention includes methods for producing AWJ mixing tubes which are comprised solely of a superhard material, it also includes methods for producing AWJ mixing tubes in which the superhard material is surrounded substantially along the length of the mixing tube with a durable material which can act to reduce the susceptibility of the mixing tube to damage from external forces or to facilitate the adaptation of the superhard material into the AWJ machining head. The durable material may also function to reinforce the superhard material so as to prevent the AWJ mixing tube from being damaged by water jet back pressure should the mixing tube become plugged during operation. The present invention also includes methods for producing AWJ mixing tubes which comprise at least one jacket which acts to reduce the susceptibility of the AWJ mixing tube from impact damage or to facilitate the adaptation of the AWJ mixing tube into the AWJ machining head.

Accordingly, the present invention also comprises the steps of surrounding at least one superhard material body substantially along the length of the AWJ mixing tube with a durable material. In one embodiment, in the completed AWJ mixing tube, the durable material will extend beyond the superhard material at the entrance end of the mixing tube with a tapered entryway portion of the mixing tube being formed at least partially in the durable material and the method of the present invention includes forming the mixing tube in this fashion. The durable material is preferably a steel or, more preferably, a cemented tungsten carbide. When the tapered entryway is formed at least partially in the durable material and the durable material is a steel, it is desirable that the steel be an erosion-resistant alloy steel or tool steel.

When cemented tungsten carbide is used as the durable material, in the above one embodiment of the present invention includes the steps of (1) providing at least one composite body comprising a superhard material layer bonded to a cemented tungsten carbide substrate; (2) providing at least one durable material body; (3) bonding the at least one composite body to the at least one durable material body so as to form an AWJ mixing tube blank having a superhard material core; (4) EDM forming a tapered entryway into one end of the AWJ mixing tube blank; and (5) EDM machining a longitudinal bore through the superhard material core of the AWJ mixing tube blank. The method may further comprise the step of machining the external shape of the AWJ mixing tube blank in one or more operations to adapt the AWJ mixing cube blank to fit into an AWJ water jet machining head and to otherwise obtain the final dimensions of the AJW mixing tube. Note that the term "AWJ mixing tube blank" is used herein to refer to a single body, whether of a monolithic or a composite construction, from which an AWJ mixing tube may be formed in one or more operations and includes partially formed AWJ mixing tubes up until the last forming operation has been completed.

In this embodiment, the durable material body is provided as a single round rod having a u-shaped channel adapted for receiving the at least one strip of composite material. However, the present invention also includes providing the durable material in other shapes. The present invention also includes providing a plurality of durable material bodies which can surround and be bonded to the one or more superhard material bodies. What is important is that the resulting AJW mixing tube blank have a superhard material core into which a longitudinal bore may be formed such that the longitudinal bore will be lined with superhard material all along the length of the mixing tube, with the possible exception that, in the final AWJ mixing tube, the endmost part of the entryway length in some embodiments may not be lined with a superhard material. In some of those embodiments in which the endmost part of the entryway length is not lined with a superhard material, the present invention also includes coating the exposed durable material in the endmost part of the entryway with a hard coating deposited by vapor deposition, i.e. by physical vapor deposition (PVD) and/or chemical vapor deposition (CVD). Examples of such hard coatings include, without limitation, diamond, titanium nitride, titanium carbide, titanium carbonitride, titanium aluminum nitride, aluminum oxide, and their combinations.

The present invention also comprises AWJ mixing tubes comprising a superhard material including those AWJ mixing tubes in which the superhard material is surrounded substantially along the length of the mixing tube with a durable material which can act to reduce the susceptibility of the mixing tube to damage from external forces, to facilitate the adaptation of the superhard material into the AWJ machining head or to reinforce the superhard material so as to prevent the AWJ mixing tube from being damaged by water jet back pressure should the mixing tube become plugged during operation. The present invention also includes AWJ mixing tubes comprising an entryway piece having a superhard material formed on a tapered entryway bonded to an AWJ mixing tube body piece having a longitudinal bore lined with a superhard material and methods of making such AWJ mixing tubes.

The present invention includes AWJ mixing tubes, and methods for making same, comprising a flow passage formed by EDM in at least one abrasion-resistant material piece, wherein at least part of the flow passage has a lining comprising a superhard material. Included among these AWJ mixing tubes are single-component AWJ mixing tubes as well as multi-component AWJ mixing tubes which comprise a plurality of components and at least one connection, which may be a disconnectable connection, connecting one component to another such that the flow passages of each of the individual components communicate with each other to form the flow passage of the AWJ mixing tube and wherein the flow passage of least one of the plurality of components has a lining comprising a superhard material. As already mentioned, as used herein, the term "component" refers to a discrete, hollow segment comprising a portion of the length of an AWJ mixing tube. Each component has a flow passage which is part of the flow passage of the AWJ mixing tube. The components are connected end-to-end with each other to make the AWJ mixing tube. For example, a two-component AWJ mixing tube according to the present invention may have an entryway piece connected to an AWJ mixing tube body piece wherein the entryway piece and the AWJ mixing tube body piece each has a flow passage formed in one or more abrasion-resistant pieces and at least one of the entryway piece and the AWJ mixing tube body piece has part of its flow passage comprising a superhard material. It is to be understood that, as used herein, an AWJ mixing tube is considered to have a plurality of connected components having at least one connection if, and only if, the AWJ mixing tube comprising those components and connection or connections is an integral unit which can be handled and loaded into an AWJ cutting head as a single piece.

The present invention also includes AWJ systems having a mixing tube comprising a superhard material. Such AWJ systems include AWJ systems having an AWJ mixing tube which includes a flow passage formed by EDM in at least one abrasion-resistant material wherein at least part of the flow passage has a lining comprising a superhard material. These AWJ systems include those AWJ systems having AWJ mixing tubes which comprise a plurality of components and at least one connection, which may be a disconnectable connection, connecting one component to another such that the flow passages of each of the individual components communicate with each other to form the flow passage of the AWJ mixing tube and wherein the flow passage or least one of the plurality of components has a lining comprising a superhard material. Such AWJ systems use any type of abrasive particles including, without limitation garnet, olivine, alumina, cubic boron nitride, zirconia, silicon carbide, boron carbide, diamond, other minerals and ceramics, and their mixtures and combinations.

The present invention includes methods of using an AWJ system comprising the steps of providing an AWJ mixing tube having a flow passage formed by EDM in at least one abrasion-resistant material wherein at least part of the flow passage has a lining comprising a superhard material, providing abrasive particles, emitting the abrasive particles from the AWJ mixing tube, and machining a workpiece with the emitted abrasive particles. Such a provided AWJ mixing tube may be one which comprises a plurality of components and at least one connection, which may be a disconnectable connection, connecting one component to another such that the flow passages of each of the individual components communicate with each other to form the flow passage of the AWJ mixing tube and wherein the flow passage of least one of the plurality of components has a lining comprising a superhard material. For example without limitation, the present invention also includes methods of using an AWJ system comprising the steps of providing an abrasive water jet mixing tube having a longitudinal bore lined with a superhard material, providing abrasive particles, emitting the abrasive particles from the abrasive water jet mixing tube, and machining a workpiece with the emitted abrasive particles.

Although AWJ systems typically use water as the carrier fluid, the present invention also contemplates the application of its methods, AWJ mixing tubes, and AWJ systems with the use of any fluid (gaseous or liquid) which is capable of acting as a fluid carrier in a system which uses fluid-carried abrasive particles for cutting or machining a workpiece. Such fluids include those which are capable of replacing water, in whole or in part, as the carrier fluid in an AWJ system. Accordingly, the term "abrasive water jet" as used herein is not limited to abrasive jets using water as the carrier fluid but instead refers to any abrasive jet having a fluid carrier.

The present invention also comprises a tubular elongate superhard material body, and methods for making same, wherein the tubular elongate superhard material body has at least one bore formed by EDM which is substantially parallel to the longitudinal axis of the tubular elongate superhard material body.

The present invention also comprises superhard material cylinders having lengths of about 0.2 inches (5 mm) and diameters of about 0.2 inches (5 mm) and either a straight or conical passage or a combination of a straight and conical passage, along their longitudinal centerlines, formed by EDM machining. Such superhard material cylinders comprise a superhard material or a composite of a superhard material bonded to another abrasion-resistant material. Where a superhard material cylinder contains a straight passage, either alone or in conjunction with a conical passage, preferably the aspect ratio of the cylinder length to the diameter of the passage is at least 4 to 1, and more preferably at leas: 6 to 1, and most preferably at least 10 to 1.

These and other features and advantages inherent in the subject matter claimed and disclosed will become apparent to those skilled in the art from the following detailed description of presently preferred embodiments thereof and to the appended drawings.

BRIEF DESCRIPTION OF THE DRAWINGS

The drawings are provided only as an aid in understanding the operation of the present invention. It is to be understood, therefore, that the drawings are provided solely for the purpose of illustration and not as a definition of the limits of the present invention.

DETAILED DESCRIPTION

To aid in the understanding of the present invention, a description is first provided of a typical AWJ system and AWJ machining head wherein water is the carrier fluid before embodiments of the present invention are described.

Figure 1:
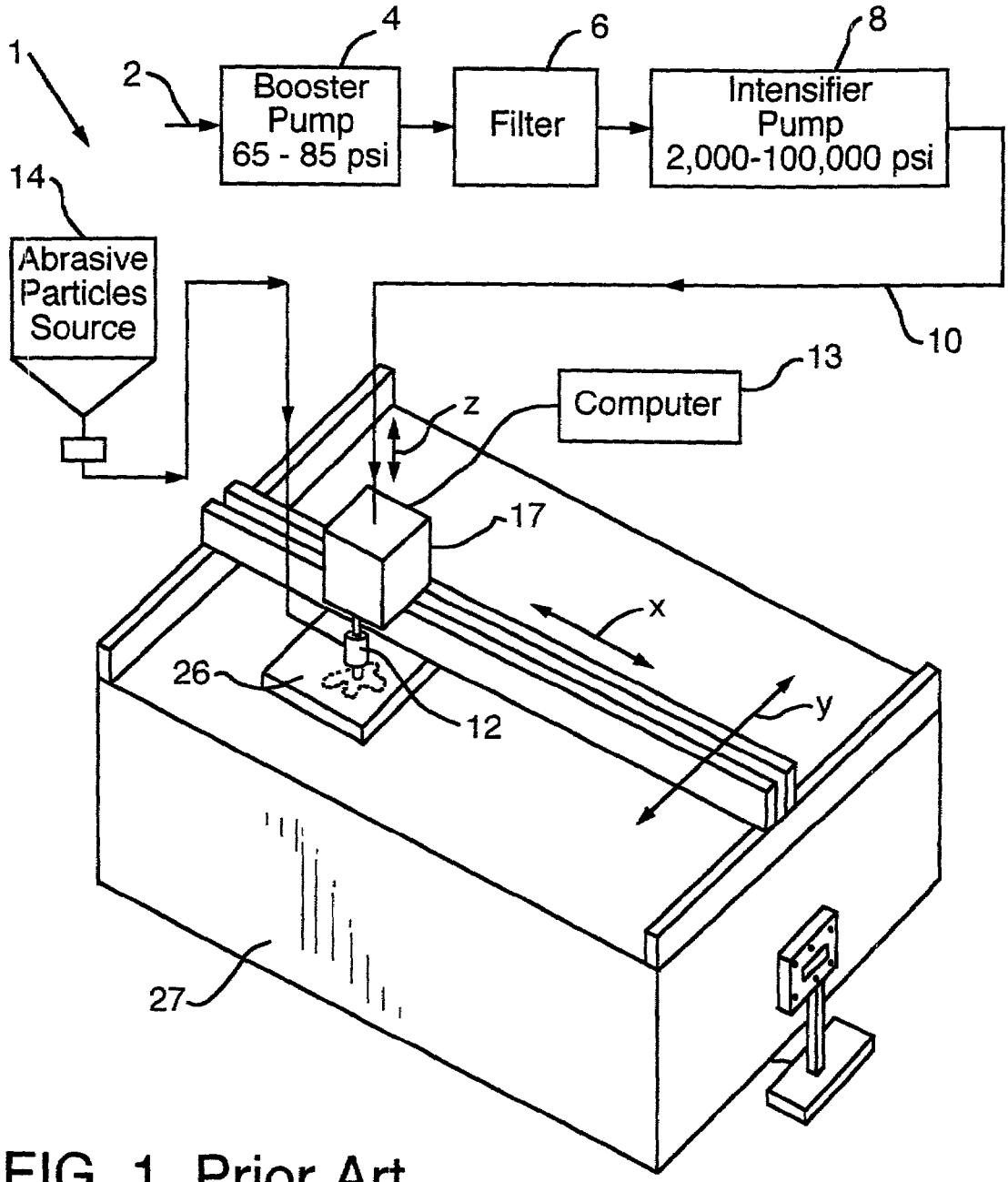
FIG. 1 Prior Art
FIG. 1 is a schematic drawing of a prior art computer-controlled AWJ system.
Figure 2:
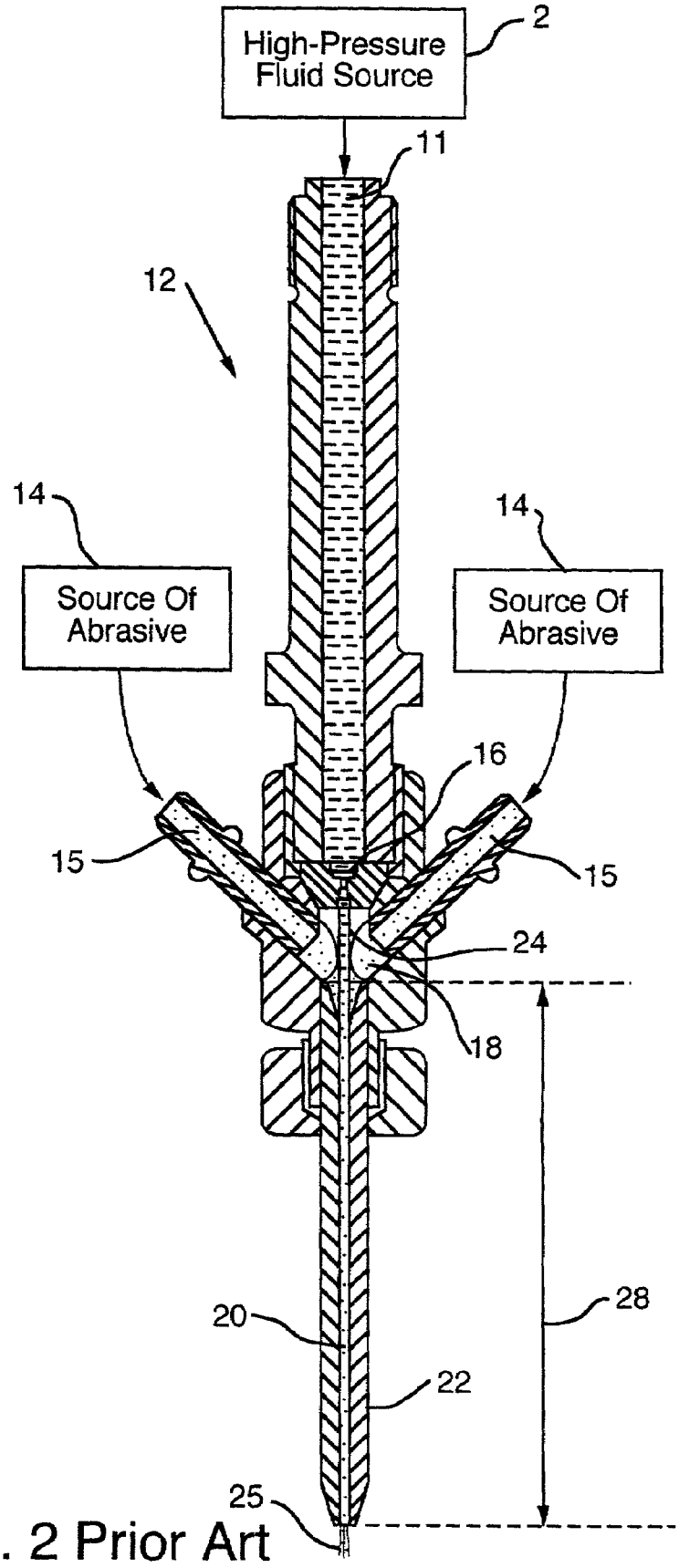
FIG. 2 Prior Art
FIG. 2 is a longitudinal cross sectional view of a prior art AWJ machining head.

FIGS. 1 and 2, respectively show a schematic of a typical computer-guided AWJ system and a cross-section of a typical AWJ machining head. Referring to FIGS. 1 and 2, in computer-guided AWJ system 1, water 2 is forced by a booster pump 4 at about 65 to 85 psi (450 to 590 kPa) through a filter 6 and then into an intensifier pump 8 where it is pressured to the range of 2,000 to 100,000 psi (14 to 690 MPa). The high pressure water 2 is delivered through swivelled high pressure piping 10 to an AWJ machining head 12 which is controlled by computer 13 and AWJ head moving mechanism 17 to be indexed along the three mutually-orthogonal axises X, Y, and Z. The high pressure water 2 enters into the high pressure water reservoir 11 of the AWJ machining head 12 and is forced out through a nozzle 16 to form a high-velocity jet 24. The high-velocity jet 24 passes through mixing chamber area 18 into which abrasive particles 15 are fed from an outside source 14. The high-velocity jet 24 and the abrasive particles 15 together flow through the longitudinal bore 20 of the AWJ mixing tube 22 and exit as abrasive water jet 25. The abrasive water jet 25 is directed against workpiece 26 machining workpiece 26 before being dissipated and collected in collection tank 27. AWJ mixing tube 22 has an overall length 28.

Figure 3:
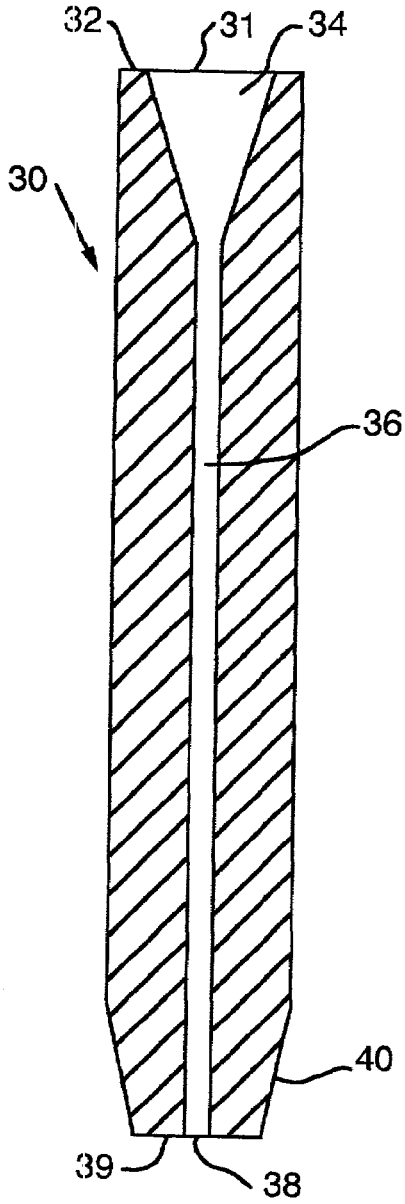
FIG. 3 is a longitudinal cross sectional view of an AWJ mixing tube comprised entirely of superhard material prepared according to a first embodiment of the present invention.

Embodiments of the present invention will now be discussed. The embodiments are discussed in some cases with reference to AWJ systems which employ water as the carrier fluid. However, it is to be understood that the reference to water is made for convenience and is in no way meant to limit the present invention to use with AWJ systems employing water as the carrier fluid. FIG. 3 shows a longitudinal cross sectional view of a first AJW mixing tube prepared according to the present invention in which the mixing tube consists solely of superhard material. Referring to FIG. 3, first AWJ mixing tube 30 has an entry end 31, entry end face 32, a tapered entryway 34, a longitudinal bore 36, an exit end 38, and an exit end face 39. In operation, the high velocity water jet and the stream of abrasive particles enter AWJ mixing tube 30 through entryway 34 and pass through longitudinal bore 36 before exiting AWJ mixing tube 30 at exit end 38 as an abrasive water jet. AWJ mixing tube 30 also has external taper 40 abutting exit end face 38. External taper 40 facilitates bringing AWJ mixing tube 30 in close proximity with some workpieces.

Figure 4:
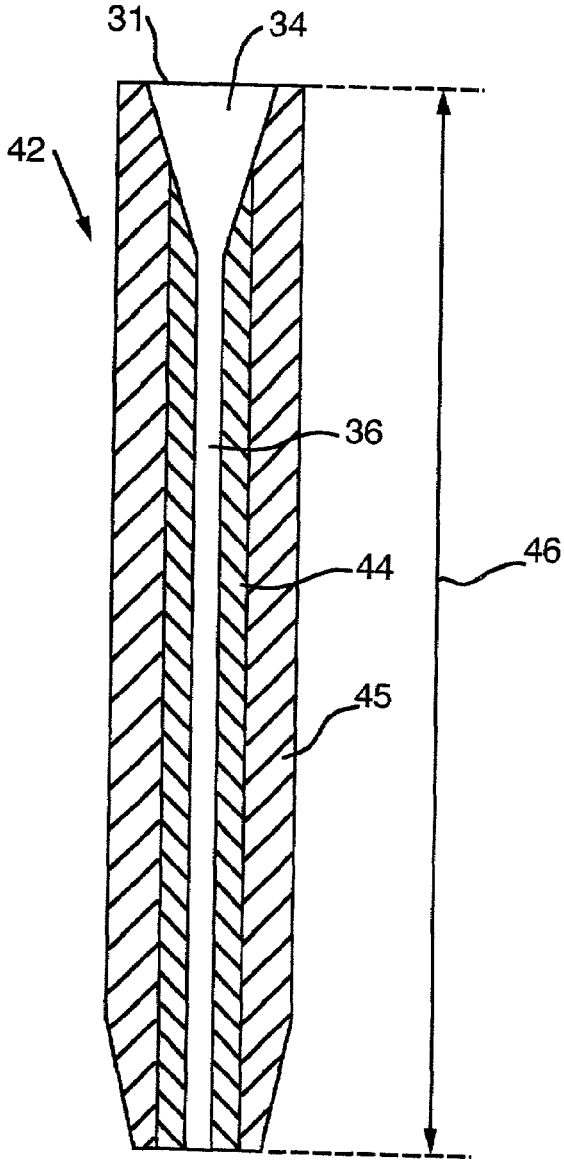
FIG. 4 is a longitudinal cross sectional view of an AWJ mixing tube comprised of durable material with a superhard material core prepared according to a second embodiment of the present invention.

FIG. 4 shows a longitudinal cross sectional view of a second AJW mixing tube prepared according to the present invention in which second AWJ mixing tube 42 has superhard material core 44 lining AWJ mixing tube longitudinal bore 36 and durable material 45 surrounding the superhard material core 44 substantially along the length 46 of AWJ mixing tube 42. A portion of superhard material core 44 was machined away during the formation of tapered entryway 34 so that durable material 45 extends beyond superhard material core 44 at entry end 31.

The methods of the present invention may be used to produce all types of AWJ mixing tubes for use in current and future AWJ machining head designs. Those designs therefore determine the dimensions of the AWJ mixing tubes produced according to the present invention. In general, in AWJ systems in which water is the carrier fluid, current AWJ mixing tubes are cylindrical with overall lengths on the order of 2 to 4 inches (5 to 10 cm), outside diameters on the order of 0.2 to 0.4 inches (5 to 10 mm), and longitudinal bore diameters on the order of 0.010 to about 0.060 inches (0.25 to 1.5 mm). AWJ mixing tube longitudinal bores usually have circular cross-sections, although non-circular cross sections and non-straight-walled longitudinal bores are also known in the art and are within the scope of the present invention. Examples of AWJ mixing tubes with longitudinal bores having noncircular cross sections are described for by Rankin et al., U.S. Pat. No. 5,626,508, which is incorporated herein by reference.

The use of EDM to form PCD and EDM-machinable PCBN is well known in the art. Therefore, the conditions necessary for each of the EDM operations utilized in the performance of the present invention may be readily ascertained by one skilled in the art without resort to undue experimentation. One skilled in the art will recognize that the specific EDM parameters will vary according to the particular workpiece being machined and the particular EDM operation being employed.

Figure 5:
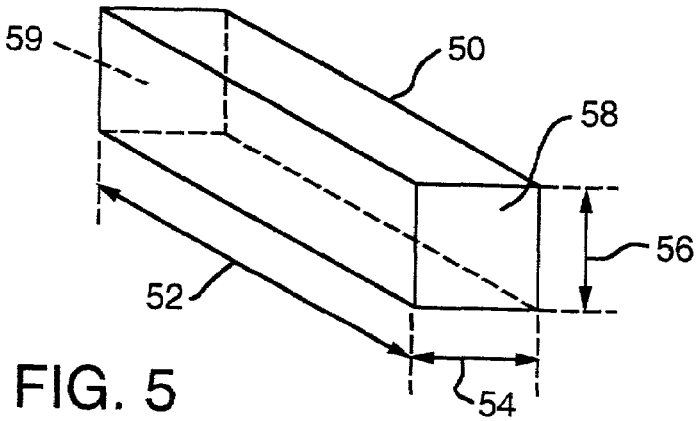
FIG. 5 is an isometric view, shown partially in phantom, of a monolithic superhard material body.

An AWJ mixing tube consisting solely of a superhard material may be made according to a first embodiment of the present invention by the following method. Referring to FIG. 5, first, a monolithic superhard material body 50 having a length 52, width 54, and thickness 56, each being sufficient to yield the final AWJ mixing tube dimensions, is provided. Length 52 is at least about 1 inch (2.5 cm) in order to make a 1 inch (2.5 cm) long AWJ mixing tube. Length 52 is preferably in the range of from about 1 to about 4 inches (2.5 to 10 cm) and more preferably in the range of from about 1.5 to about 3 inches (3.8 to 7.6 cm). The external dimensions of superhard material body 50 are altered as necessary at this time or later by EDM or other techniques known to those skilled in the art e.g., laser cutting, diamond saw or wire cutting, grinding etc., to produce the final AWJ mixing tube dimensions. Preferably, first and second end faces 58, 59 are made mutually parallel and perpendicular to the longitudinal axis of superhard material body 50. First and second end faces 58, 59 shown in FIG. 5 correspond respectively to AWJ mixing tube entry end face 31 and AWJ mixing tube exit end face 39 of FIG. 3. EDM plunge forming is then used to form a tapered entryway, such as tapered entryway 34 shown in FIG. 3, in first end face 58. EDM drilling is then used to form a longitudinal bore, such as longitudinal bore 36 shown in FIG. 3, along the longitudinal axis of the superhard material body 50 from the apex of the tapered entryway through second end face 59.

Figure 6:
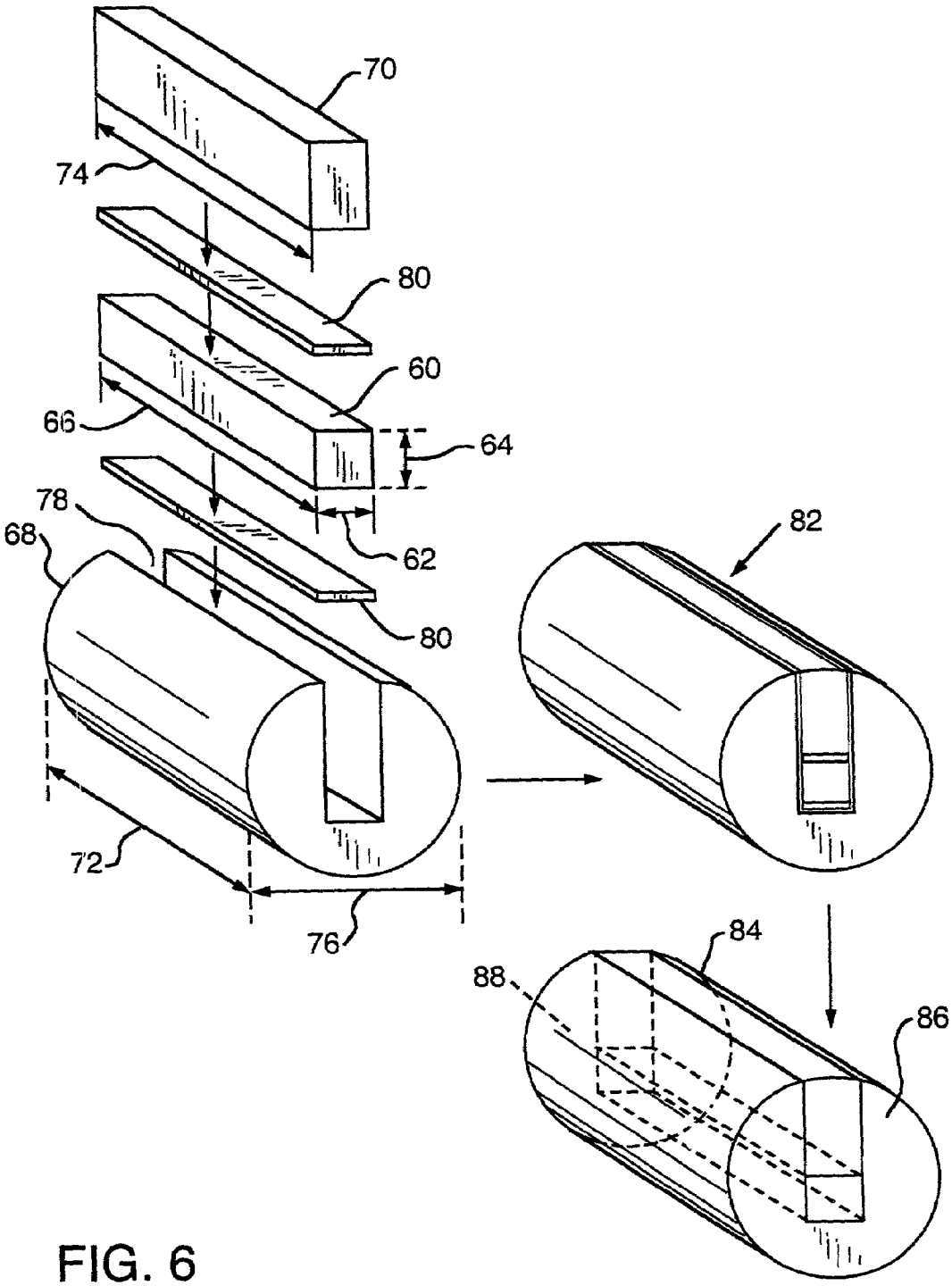
FIG. 6 is a schematic drawing depicting some of the processing steps of a second embodiment of the present invention.

A method according to a second embodiment of the present invention will now be described for producing an AWJ mixing tube having a superhard material-lined longitudinal bore surrounded by a durable material. Referring to FIG. 6, a monolithic superhard material body 60 is provided. Superhard material body 60 has a width 62 and thickness 64 sufficient to provide at least 0.005 inches (0.13 mm), and more preferably at least 0.010 inches (0.25 mm), of superhard material thickness surrounding the AWJ mixing tube longitudinal bore in the resulting AJW mixing tube. Superhard material body 60 also has a length 66 sufficient to yield the final AWJ mixing tube length. First and second durable material bodies 68, 70 are also provided, having lengths 72, 74 respectively which are sufficient to yield the final AWJ mixing tube length. First durable material body 68 has diameter 76 sufficient to yield the outside dimensions of the resulting AWJ mixing tube. First durable material body 68 has a cavity 78 adapted to coextensively receive both body 60 and second durable body 70 along with bonding material 80. First durable material body 68, superhard material body 60, and bonding material 80 are assembled together into assembly 82 such that superhard material body 60 forms a core section along the longitudinal centerline of assembly 82 with second durable material body 70 and bonding material 80 substantially filling the remaining portion of cavity 78. Preferably, superhard material body 60 and second durable material body 70 fit in cavity 78 with just enough clearance to accommodate bonding material 80. A sufficient amount of bonding material 80 is used to bond together assembly 82 with sufficient strength and uniformity as is required for the later manufacturing steps and in-service use of the resulting AWJ mixing tube. The assembly 82 is bonded together using whatever fixturing may be appropriate under the circumstances, to form AWJ mixing tube blank 84. Where bonding material 80 is a brazing material, the bonding step is accomplished by raising the temperature of assembly 82 to the appropriate brazing temperature and then cooling assembly 82 at a cooling rate that will safeguard the physical integrity of AWJ mixing tube blank 84. Where bonding material 80 is an adhesive, the steps necessary for curing the adhesive are performed. After the bonding has been completed, the external dimensions of AWJ milling tube blank 84 are altered as necessary at this time or later by the machining techniques known to those skilled in the art which are appropriate for the durable material to produce the final AWJ mixing tube-dimensions. Preferably, first and second end faces 86, 88 of the AWJ milling tube blank 84 are made mutually parallel and perpendicular to the longitudinal axis of the AJW mixing tube blank 84. A tapered entryway, such as tapered entryway 34 as shown in FIG. 4, is then formed in first end face 86, preferably by EDM plunge forming. EDM drilling is then used to form the AWJ mixing tube longitudinal bore, such as longitudinal bore 36 as shown in FIG. 4, along the longitudinal axis of the AWJ milling tube blank 84 from the apex of the tapered entryway through second end face 88. Final machining of AWJ milling tube blank 84 may then be performed as necessary to yield the final outer dimensions of the AWJ mixing tube.

In a third embodiment of the present invention, a plurality of individual superhard material bodies are provided in the above method instead of a single superhard material body. In this embodiment, each of the individual superhard material bodies has a first and second end face such that the distance between the first and second end face comprises the length of the individual superhard material body. The embodiment includes abutting at least one of the first and second end faces of each individual superhard material body against one of the first and second end faces of another individual superhard material body so that the plurality of the individual superhard material bodies together form the superhard material core of the AWJ mixing tube blank. In other words, the individual superhard material bodies are placed end to end to yield the overall length of the AWJ mixing tube superhard material core.

Figure 7:
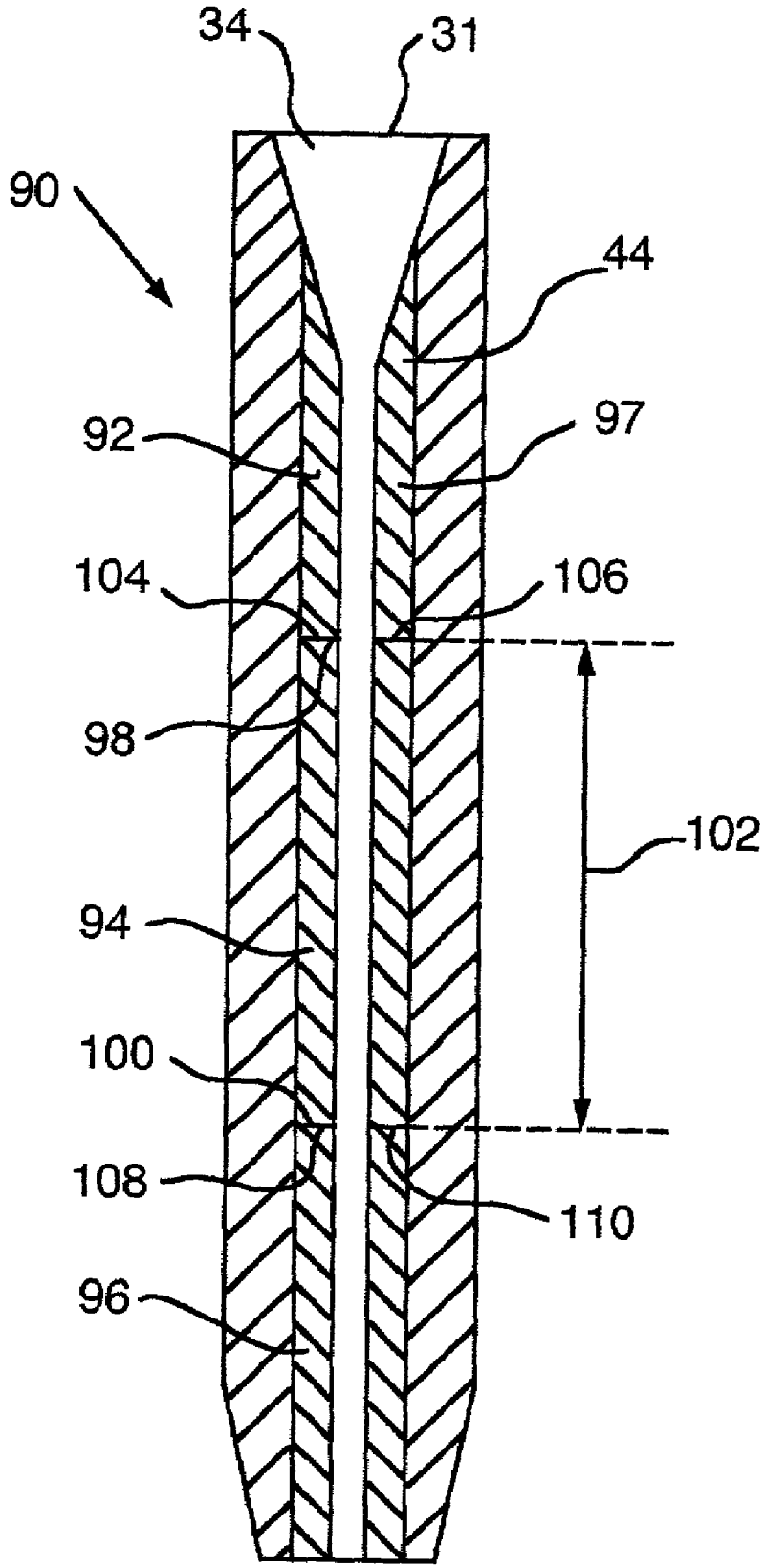
FIG. 7 is a longitudinal cross sectional view of an AWJ mixing tube prepared according to a third embodiment of the present invention.

FIG. 7 shows a cross sectional view of AWJ mixing tube 90 made in accordance with this third embodiment of the present invention. AWJ mixing tube 90 includes a plurality of individual superhard material bodies, first, second, and third superhard material bodies 92, 94, 96 which together comprise segmented superhard material core 97. In the condition in which the individual superhard material bodies were provided prior to assembly, each of the individual superhard material bodies 92, 94, 96 had a first and second end face such that the distance between the first and second end faces comprised the length of the individual superhard material body. For example, second superhard material body 94 had and still has end faces 98, 100, with the distance between them comprising the length 102 of second superhard material body 94. However, during the formation of the tapered entryway 34, a portion of first superhard material body 92 was machined away, which included what was its first face in the as-provided condition. End face 104 of first superhard material body 92 abuts end face 98 of second superhard material body 94 along first interface 106 and end face 100 of second superhard material body 94 abuts end face 108 of third superhard material body 96 along second interface 110. It is important that the end faces of adjacent superhard material bodies are abutted together precisely enough to avoid excessive erosion wear at the abutment interfaces during the operation of the resulting AWJ mixing tube. For example, end faces 100, 108 of adjacent superhard material bodies 94, 96 are abutted together precisely enough to avoid excessive erosion wear at abutment interface 110 in third AWJ mixing tube 90. Excessive erosion is localized erosion that is substantially greater than that erosion occurring generally along the AWJ mixing tube longitudinal bore. Thus, it is preferred that each of the end faces of the individual superhard material bodies be machined and/or ground flat, co-parallel with its opposing face, and perpendicular to the superhard material body's longitudinal axis.

Figure 8:
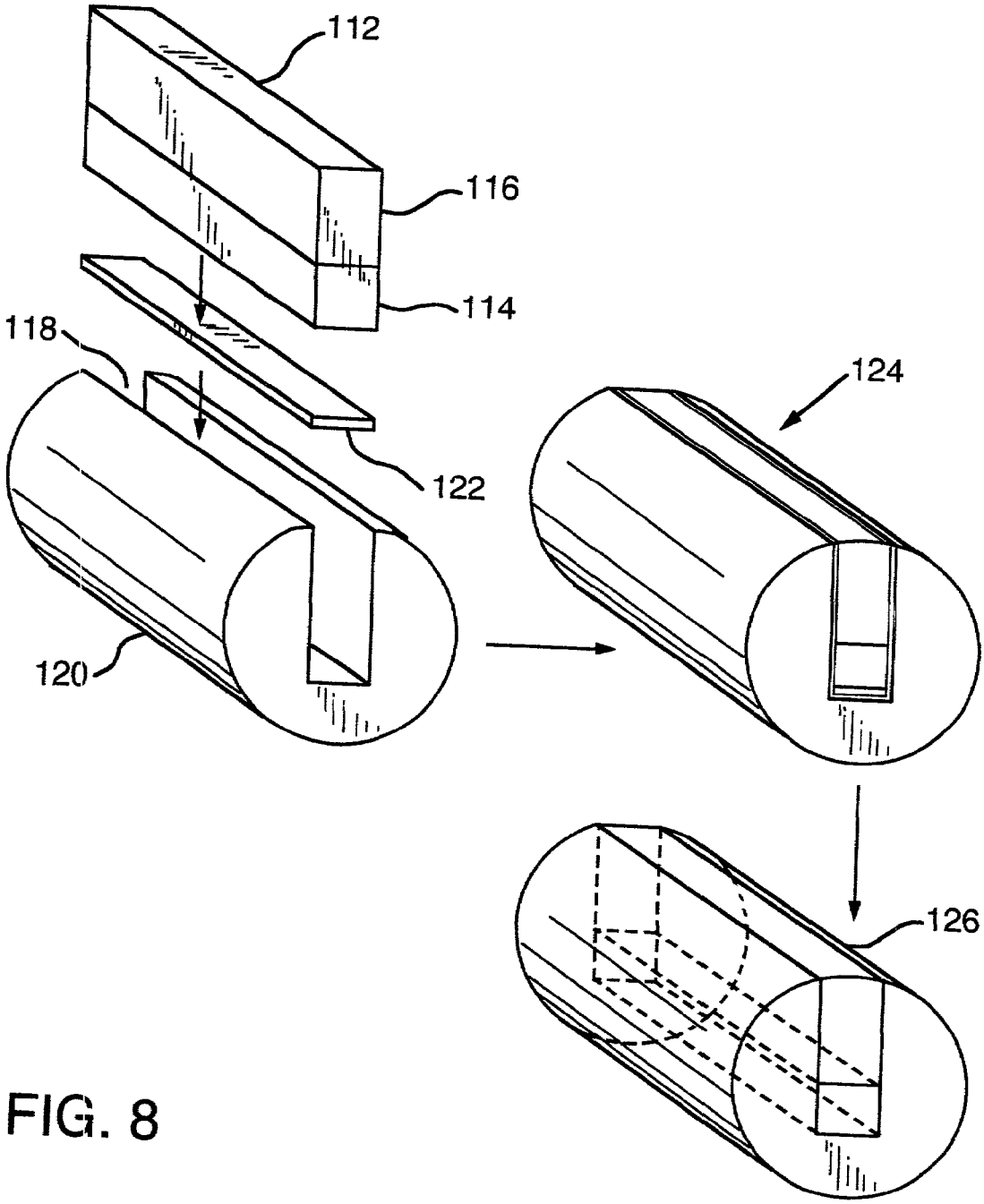
FIG. 8 is a schematic drawing depicting some of the processing steps of a fourth embodiment of the present invention.

Referring to FIG. 8, in a fourth embodiment of the present invention, wherein cemented carbide is used as the durable material, superhard material is provided as part of composite 112. Composite 112 has a superhard material layer 114 bonded to a cemented tungsten carbide substrate 116. Preferably, superhard material layer 114 is formed on cemented tungsten carbide substrate 116 during the superhard material synthesis process and composite 112 is a strip that has been EDM machined from a disc of a superhard material-cemented tungsten carbide composite that resulted from the superhard material synthesis process. Composite 112 is coextensively received into cavity 118 of durable material body 120 along with bonding material 122 so that superhard material layer 114 forms a core section along the longitudinal centerline of assembly 124 and cemented carbide substrate 116 of composite 112 fills at least some, and preferably all, of the remaining portion of cavity 118 with just enough clearance to accommodate bonding material 122. Where the composite along with bonding material does not completely fill the receiving cavity, then one or more supplemental durable material bodies are provided and used to substantially fill the remaining space in the cavity. Assembly 124 is then bonded to form AWJ mixing tube blank 126 which is then processed utilizing the steps as described above for other embodiments of the present invention.

So far for embodiments of the present invention in which a durable material is used, the durable material is described as being supplied in the form of a cylindrical body with a cavity for receiving a superhard material body and additional durable material to complete the longitudinal surrounding of the superhard material body with durable material. However, the present invention also includes methods for assembling any configurations of durable material and superhard material bodies that can be bonded together to form an AWJ mixing tube blank having a core of superhard material surrounded substantially along the length of the AWJ mixing tube blank by durable material. The only restrictions contemplated by the present invention for such methods are that (1) the AWL longitudinal bore be surrounded by superhard material of at least 0.005 inches (0.13 mm), and preferably, at least 0.010 inches (0.25 mm) thick, and (2) where a plurality of superhard material bodies are used to form the superhard material core, that the faces of adjacent superhard material are made to abutt together precisely enough to avoid excessive erosion wear at the abutment interfaces during the operation of the resulting AWJ mixing tube.

Figure 9A:
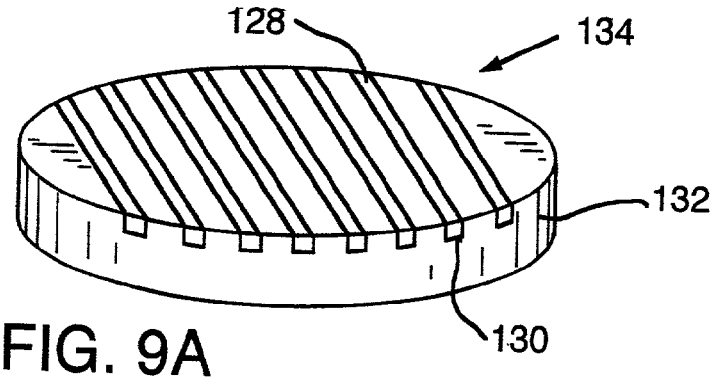
FIG. 9A is an isometric view of a composite disc comprising superhard material formed in and bonded to grooves of a cemented tungsten carbide substrate.
Figure 9B:
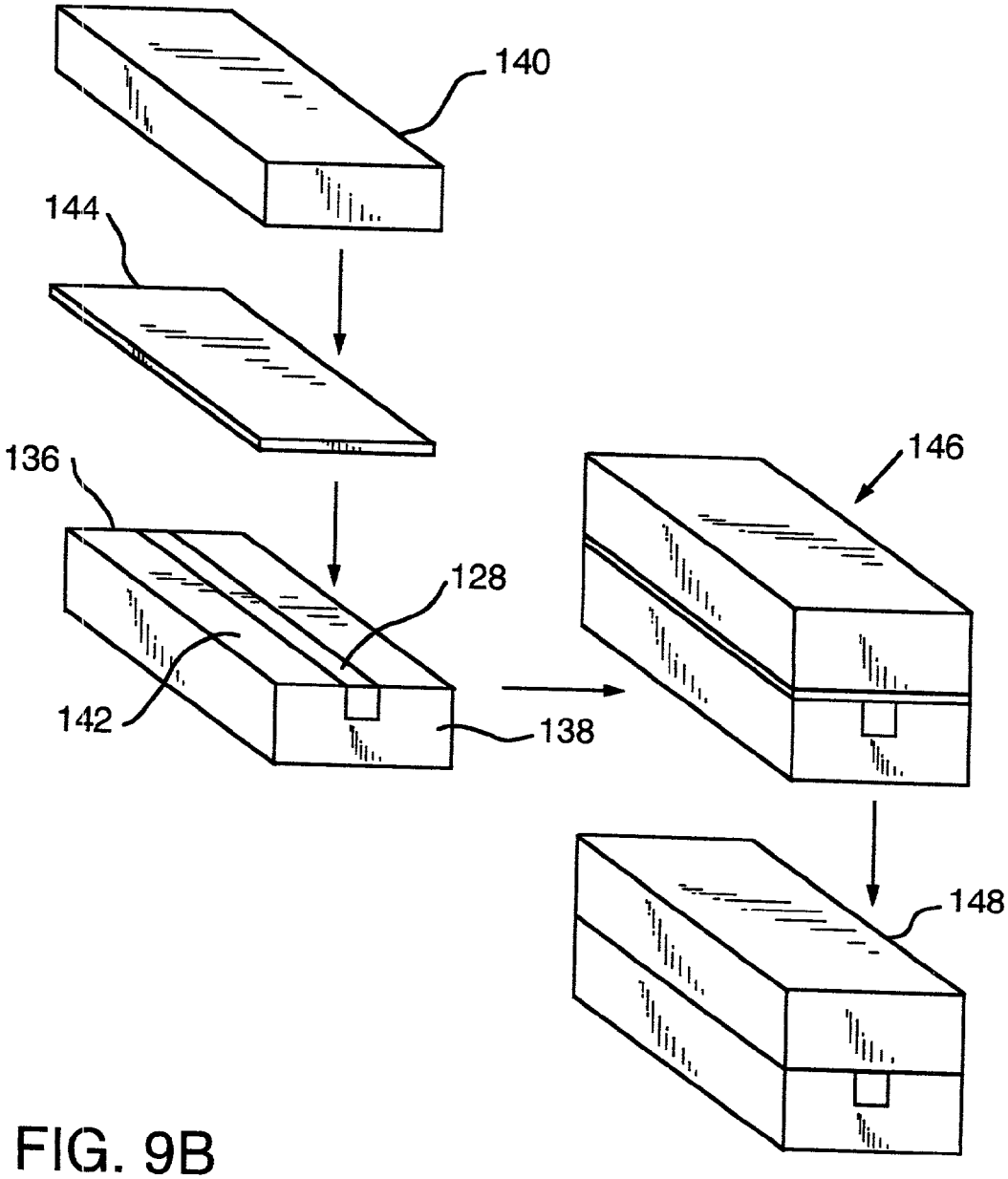
FIG. 9B is a schematic drawing depicting some of the processing steps of a fifth embodiment of the present invention.

For example, in a fifth embodiment of the present invention, a major portion of the durable material is not provided as in the form of a cylindrical body having a cavity for receiving a body superhard material body but rather is provided as part of a composite of the durable material and superhard material. Referring to FIG. 9A, superhard material body 128 is formed in and is bonded to a groove 130 of a cemented tungsten substrate 132 of composite disc 134. Composite disc 134 is sectioned, preferably by EDM machining, into strips such as composite strip 136, with each strip having a superhard material body 128 surrounded on three sides by cemented tungsten carbide as durable material 138. A durable material closure body 140 of a cemented tungsten carbide is provided and placed onto face 142 of composite strip 136 along with bonding material 144 to form assembly 146. Durable material closure body 140 is then bonded to composite strip 136 to form AWJ mixing tube blank 148 which is then processed into an AWJ mixing tube utilizing the steps described above for other embodiments of the present invention.

Figure 10:
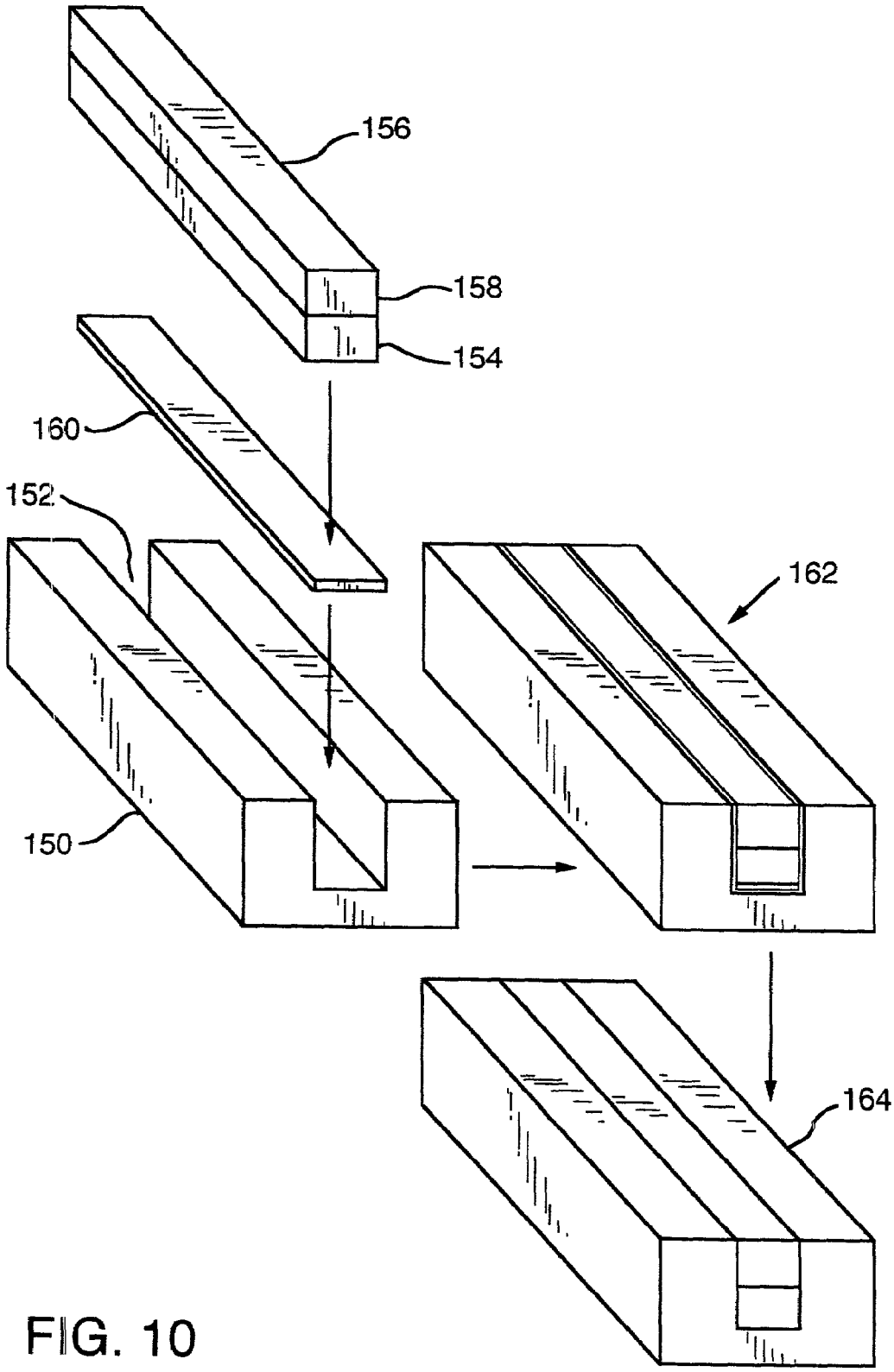
FIG. 10 is a schematic drawing depicting some of the processing steps of a sixth embodiment of the present invention.

As a further example of possible configurations of durable material and superhard material bodies that can be used according to the present invention, in a sixth embodiment, referring to FIG. 10, u-shaped durable material body 150 having cavity 152 is provided. A superhard material body 154 is provided as part of composite body 156. Composite body 156 comprises superhard material body 154 formed on and bonded to cemented tungsten carbide substrate 158. Composite body 156 is coextensively received into cavity 152 of u-shaped durable material body 150 along with bonding material 160 so that superhard material body 154 forms a core section along the longitudinal centerline of assembly 162 and cemented tungsten carbide substrate 158 of composite body 140 fills at least some, and preferably all, of the remaining portion of cavity 152 with just enough clearance to accommodate bonding material 160. Assembly 162 is then bonded to form AWJ mixing tube blank 164 which is then processed utilizing the steps as described above for other embodiments of the present invention.

In some of embodiments of the present invention in which a tapered entryway is formed in the AWJ mixing tube in a manner which causes a portion of the durable material to be exposed in the entryway, the present invention optionally includes the step of depositing a hard coating by vapor deposition, i.e. by physical vapor deposition (PVD) and/or chemical vapor deposition (CVD), on the exposed durable material. Examples of such hard coatings include, without limitation, diamond, titanium nitride, titanium carbide, titanium carbonitride, titanium aluminum nitride, aluminum oxide, and their combinations. The hard coating provides protection to the underlying durable material that would otherwise be exposed to erosion by the high velocity water jet and the abrasive particles entering the AWJ mixing tube entryway. The hard coating may consist of one or more layers and may be applied either directly onto the exposed durable material or onto one or more intermediate layers of other materials deposited to promote the adhesion or durability of the hard coating. The thickness of the hard coating is preferably in the range of 1 to 50 micrometers.

Figure 11A:
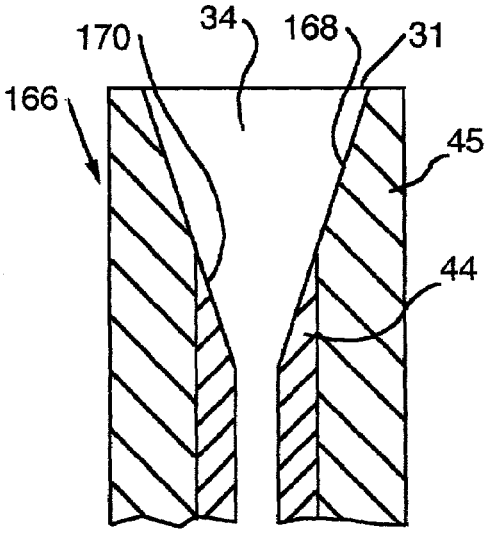
FIG. 11A is a longitudinal cross sectional view of a portion of an AWJ mixing tube prepared according to a seventh embodiment of the present invention prior to the step of depositing a CVD diamond coating.
Figure 11B:
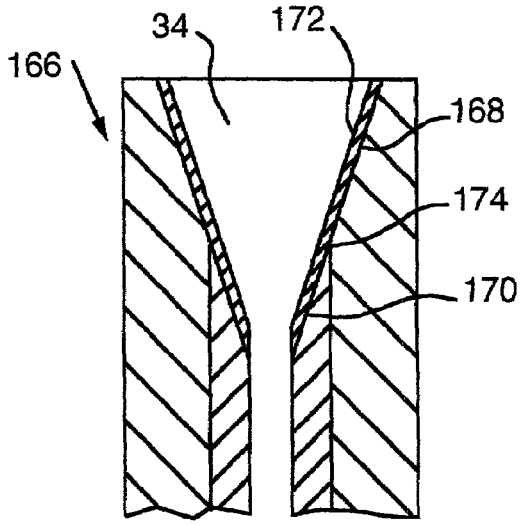
FIG. 11B is a longitudinal cross sectional view of a portion of an AWJ mixing tube prepared according to a seventh embodiment of the present invention after the step of depositing a CVD diamond coating.

For example, FIGS. 11A and 11B show respectively the entry portion of an AWJ mixing tube prepared by a method according to a seventh embodiment of the present invention before and after a CVD diamond coating has been directly deposited onto exposed durable material in the entryway. Referring to FIG. 11A, in this embodiment, the AWJ mixing tube 166 is prepared utilizing the steps described above for other embodiments of the present invention in which an entryway is formed. In this case, the formation of entryway 34 has removed a portion of superhard material core 44 nearest entry end 31 of AWJ mixing tube 166 causing durable material 45 to have exposed face 168 inside of entryway 34 adjacent to superhard material core face 170. Referring to FIG. 11B, after entryway 34 has been formed, a diamond coating 172 is applied by CVD in one or more layers on the durable material exposed face 168 in the entryway 34. Preferably, diamond coating 172 also extends over at least a portion of superhard material core face 170 so that the junction 174 between the durable material exposed face 168 and superhard material core face 170 is covered by the CVD diamond coating 172. Techniques for depositing hard coatings by CVD are well known in the art and the conditions necessary for depositing a CVD hard coating in this step may be readily ascertained by one skilled in the art without resort to undue experimentation.

Embodiments of the present invention include AWJ mixing tubes, and methods for making same, comprising a flow passage formed by EDM in at least one abrasion-resistant material piece, wherein at least part of the flow passage has a lining comprising a superhard material. The thickness of the superhard material lining is preferably at least about 0.005 inches (0.13 mm) and more preferably at least about 0.010 inches (0.25 mm). Included among these embodiments are single-component AWJ mixing tubes as well as multi-component AWJ mixing tubes which comprise a plurality of components and at least one connection, which may be a disconnectable connection, connecting one component to another such that the flow passages of each of the individual components communicate with each other to form the flow passage of the AWJ mixing tube and wherein the flow passage of at least one of the plurality of components has a lining comprising a superhard material. For example, the present invention includes AWJ mixing tubes comprising an entryway piece connected to an AWJ mixing tube body piece. The present invention also includes AWJ mixing tubes having a connected exit section. It is to be understood that, as used herein, an AWJ mixing tube is considered to have a plurality of connected components having at least one connection if, and only if, the AWJ mixing tube comprising those components and connection or connections is an integral unit which can be handled and loaded into an AWJ cutting head as a single piece.

In embodiments which include a disconnectable connection, preferably at least one of the AWJ mixing tube component parts which is connected by the disconnectable connection is potentially reusable. As contemplated by the present invention, a connection is disconnectable so long as the procedure by which the connection was made can be reversed to disconnect the components without damaging the reusable component to the point where it is unsuitable for further use. For example without limitation, a disconnectable connection may be made by threading, press fitting, brazing or adhesively bonding together the mating ends of adjacent components.

In embodiments of the present invention which comprise one or more connections between component parts of an AWJ mixing tube, each connection is formed so that the flow passage of the AWJ mixing tube is continuous and unobstructed and adjacent components are abutted together precisely enough to avoid excessive erosion wear at their interfaces during the operation of the AWJ mixing tube.

The present invention also includes embodiments in which an AWJ mixing tube having superhard material-lined longitudinal bore includes an AWJ mixing tube body portion bonded to an entryway piece. The entryway piece in these embodiments has a tapered entryway that is formed in a durable material substrate and superhard material which is formed on the tapered entryway of the durable material substrate. Preferably, but not necessarily, the entryway piece also has a bore section extending from the apex of its tapered entryway and superhard material is also formed on this bore section. The thickness of the superhard material on the tapered entryway and on the optional bore section of the entryway piece is at least about 0.005 inches (0.13 mm) and more preferably at least about 0.010 inches (0.25 mm). The superhard material thickness of the entryway piece may be the same or different from the thickness of the superhard material of the AWJ mixing tube body portion. The AWJ mixing tube body portion is produced utilizing the steps described above for other embodiments of the present invention for making an AWJ mixing tube having a superhard material-lined longitudinal bore with the exception of forming the entryway portion. The entryway piece and the body portion are bonded together such that the centerline of the tapered entryway of the entryway piece and the centerline of the bore of the AWJ mixing tube body portion are essentially collinear. The bonding may be accomplished by using a bonding material such as a braze or an adhesive.

Figure 12:
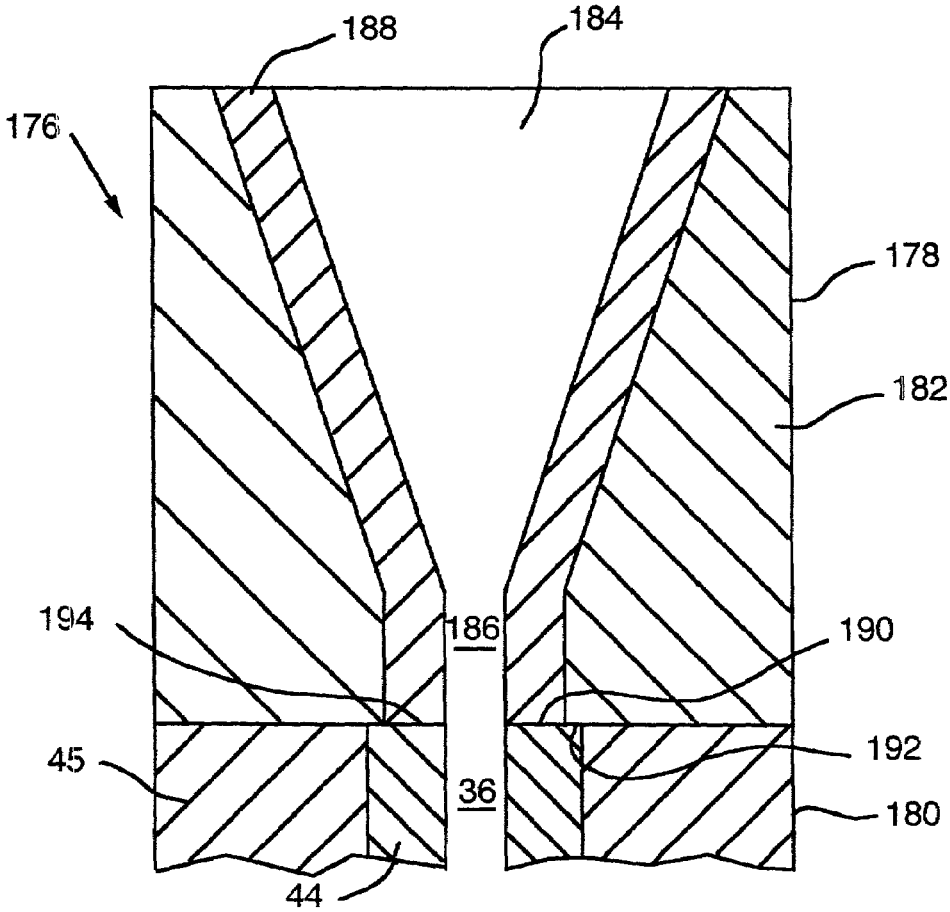
FIG. 12 is a longitudinal cross sectional view of the entryway end portion of an AWJ mixing tube, prepared according to an eighth embodiment of the present invention, comprising an AWJ mixing tube body portion bonded to an entryway piece.

FIG. 12 shows the entryway end of an AWJ mixing tube according to an eighth embodiment of the present invention wherein the AWJ mixing tube comprises an entryway piece and an AWJ mixing tube body portion. Referring to FIG. 12, AWJ mixing tube 176 includes entryway piece 178 and AWJ mixing tube body piece 180 which are bonded together. Entryway piece 178 consists of durable material substrate 182 having tapered entryway 184 and bore extension 186 onto which superhard material 188 was formed. AWJ mixing tube body piece 180 includes durable material 45, superhard material core 44 and longitudinal bore 36. Superhard material end face 190 of entryway piece 178 and core end face 192 of AWJ mixing tube body piece 180 abut each other along interface 194. It is important that end faces 190, 192 are abutted together precisely enough to avoid excessive erosion wear at interface 194 during the operation of the resulting AWJ mixing tube.

Figure 13:
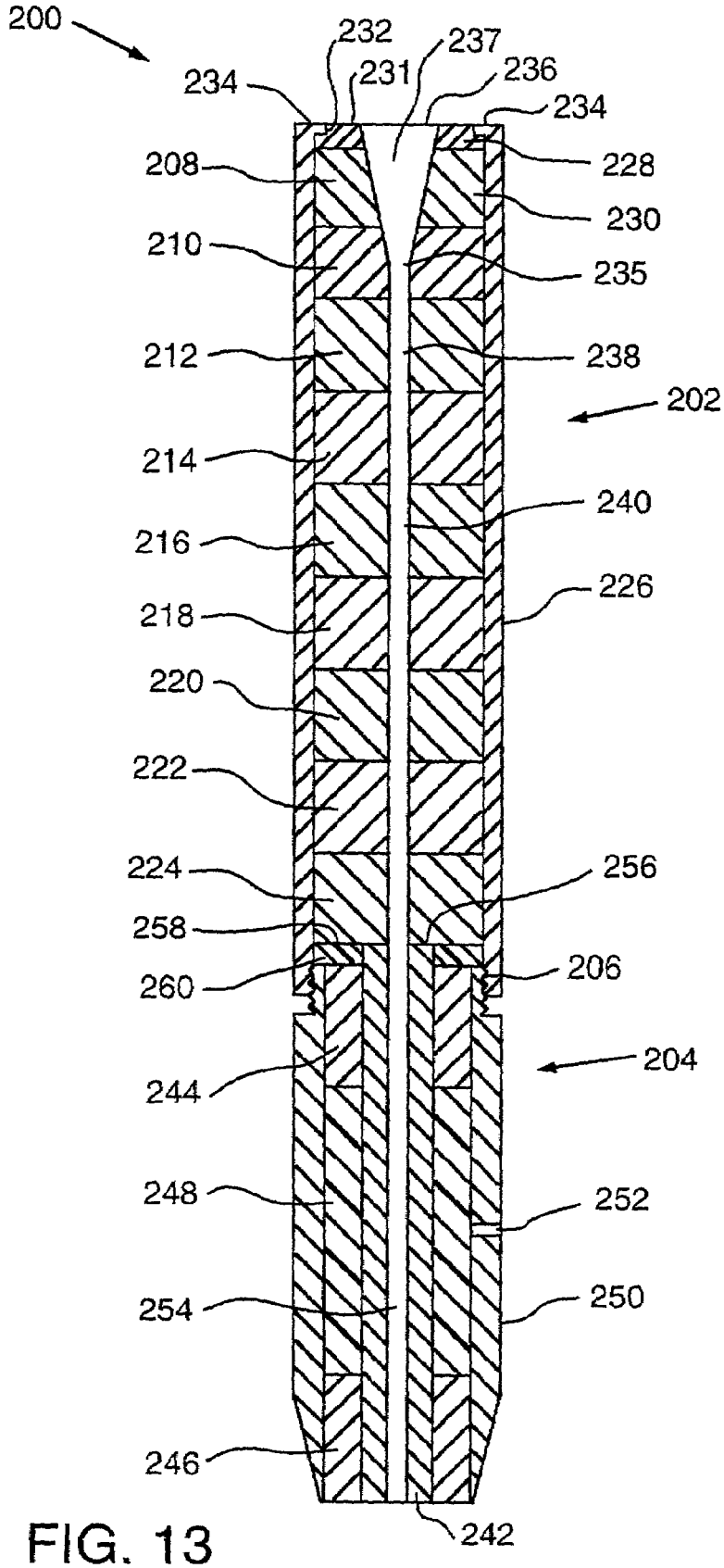
FIG. 13 is a longitudinal cross sectional view of an AWJ mixing tube prepared according to a ninth embodiment of the present invention.

FIG. 13 shows an AWJ mixing tube according to a ninth embodiment of the present invention. This embodiment illustrates the use of a threaded joint to disconnectably connect the components of an AWJ mixing tube according to the present invention. This embodiment also illustrates additional construction configurations which can be used for constructing AWJ mixing tubes in accordance with the present invention.

In this embodiment, AWJ mixing tube 200 comprises top section 202 which is disconnectably connected to bottom section 204 at threaded joint 206. Top section 202 consists of cylindrical composite disk 208 and one or more superhard material disks, e.g., cylindrical superhard material disks 210-224. These disks are enclosed within upper section jacket 226. Composite disk 208 and superhard material disk 210 extend radially to upper jacket section 226. Superhard material disks 210-224 need not extend that far radially and may have some other abrasion-resistant material interposed between their outer periphery and upper jacket section 226.

Each of the superhard material disks 210-224 may be cut from a larger piece of superhard material by EDM or other means known to one skilled in the art or may be synthesized to, or near to, their final dimensions. The thickness in the longitudinal direction need not be the same for all of the superhard material disks 210-224 and may take on any value, but each superhard material disk 210-224 preferably has a thickness in the range of about 0.06 to about 0.2 inches (1.5 to 5 mm).

Composite disk 208 comprises tungsten carbide layer 228 and superhard material layer 230 which are bonded together-the bonding preferably occurring during the formation process of superhard material layer 230. Tungsten carbide layer 228 forms rim 231 on entry end 236 of AWJ mixing tube 200. Although a superhard material disk could be used in place of composite disk 208, it is more preferable that the disk at entry end 236 of the AWJ mixing tube 200 be made of a composite material consisting of a superhard material and an abrasion-resistant material which is less hard than a superhard material. This is because it is easier to form a recess, such as recess 232, to receive upper section jacket shoulder 234 in rim 231 in such an abrasion-resistant material than it is in a superhard material. The thickness of the abrasion resistant material should be as small as possible while still allowing formation of the recess.

The transition between the tapered entryway and the bore section is preferably located away from an interface between a composite disk and a superhard material disk or an interface between two superhard material disks. FIG. 13 illustrates this preference as transition 235 between tapered entryway 237 and upper longitudinal bore 238 is located within a superhard material disk, superhard material disk 210, and away from such interfaces.

Top section 202 may be constructed by assembling composite disk 208 and superhard material disks 210-224 into upper section jacket 226 and then EDM machining of the tapered entryway 237 and upper section longitudinal bore 238 may be done. EDM machining these portions of flow passage 240 of AWJ mixing tube 200 after the disks 208-224 have been assembled together avoids mismatches at the junctions of adjacent disks along flow passage 240 thereby minimizing erosion at those locations during the operation of AWJ mixing tube 200. Preferably, the adjacent faces of adjacent disks are prepared to enhance their mating with one another. This may be done, for example without limitation, by EDM planing and/or mechanically grinding or polishing adjacent faces to match each other's contours. It is important that the end faces of adjacent superhard material disks are abutted together precisely enough to avoid excessive erosion wear at the abutment interfaces during the operation of the resulting AWJ mixing tube.

The step of assembling the superhard material disks together may be accomplished in a variety of ways. For instance, as is the case in FIG. 13, the disks 208-224 may be simply inserted or pressed against one another into upper body jacket 226. Alternatively, adjacent disks may be bonded together by adhesives or by brazing prior to or after they have been inserted into the jacket. Small amounts of a gasketing material or very thin shims may be used between the faces of adjacent superhard material disks to improve their mating or to protect the superhard material disks from damage during the insertion or press fitting operations. Preferably, a spacing material is used to fill in any space between the assembled superhard material disks and the jacket to fix the location of the superhard material disks in relation to the jacket.

Referring still to FIG. 13, bottom section 204 comprises abrasion-resistant material core 242, first and second centering couplings 244, 246, spacing material 248, and bottom section jacket 250. The abrasion-resistant material comprising abrasion-resistant material core 242 is most preferably a superhard material. A "centering coupling," as that term is used herein, is a device which serves to center one or more pieces of abrasion-resistant material within an AWJ mixing tube jacket so that the abrasion-resistant material piece or pieces are positioned to properly align the AWJ mixing tube bore. A centering coupling also serves to hold the abrasion-resistant material centered in place while a spacing material is inserted between the abrasion-resistant material and the jacket. In embodiments employing centering couplings, one or more centering couplings may be used. Preferably, a center coupling is tubular in shape and has an outside diameter which makes a close sliding fit with the inside diameter of the jacket into which it is to be inserted and an inside diameter that makes a close sliding fit with the abrasion-resistant material piece or pieces that it will contain. Where a single centering coupling is used with two abrasion-resistant material pieces and the cross-sectional size and/or shape of one of the abrasion-resistant material pieces differs from that of the other, the interior of the centering coupling should be adapted to closely receive each of the abrasion-resistant material pieces. Any gaps that exist between the centering coupling interior and the abrasion-resistant material piece or pieces may be filled in with a spacing material.

Bottom section 204 may be constructed by first sliding first and second centering couplings 244, 246 onto the opposite ends of abrasion-resistant material core 242. This assembly is inserted into bottom section jacket 250. Space filling material 248 is then interposed between bottom section jacket 250 and abrasion-resistant material core 242 by injecting space filling material 248 in fluid form through injection port 252. Spacing material 248 also flows into any gaps that might exist between abrasion-resistant material core 242 and first and second centering couplings 244, 246. Bottom section longitudinal bore 254 may be EDM machined into abrasion-resistant material core 242 at this time.

Top and bottom sections 202, 204 are connected together by threadably connecting these two components together at joint 206 until the upper end face 256 of abrasion-resistant material core 242 comes into mating contact with lower end face 258 of lowermost superhard material disk 224. Preferably, end faces 256, 258 are conditioned so that they abut one another precisely enough to avoid excessive erosion wear at their interface during the operation of AWJ mixing tube 200. Gasket 260 is optionally used at the junction of top and bottom sections 202, 204 to help avoid the over tightening of these two components so as to prevent damaging abrasion-resistant core 242 or lower-most superhard material disk 244.

As was just described, the separate portions of flow passage 240 which are located, respectively, in the top and bottom sections 202, 204 may be machined prior the joining together of these components of AWJ mixing tube 200. Another option is to wait until after the top and bottom sections are joined together to do some or all of the EDM machining of flow passage 240. The former approach has the advantage of facilitating the replacement of a worn component during the use of the AWJ mixing tube, while the latter approach has the advantage of reducing the chance of mismatch at the junction of the lower-most superhard material disk 224 and abrasion-resistant material core 242 and minimizing erosion at their interface.

Although top and bottom sections 202, 204 components of AWJ mixing tube 200 are shown as having different constructions, it is to be understood that these components may have similar constructions. Furthermore, the construction of either component may be made according to any manner or combination of manners which have been described with regard to any of the embodiments of the present invention. It is also to be understood that embodiments of the present invention which comprise components which are disconnectably connected together may include any number of components and that the relative lengths of the components may take on any value.

Figure 14:
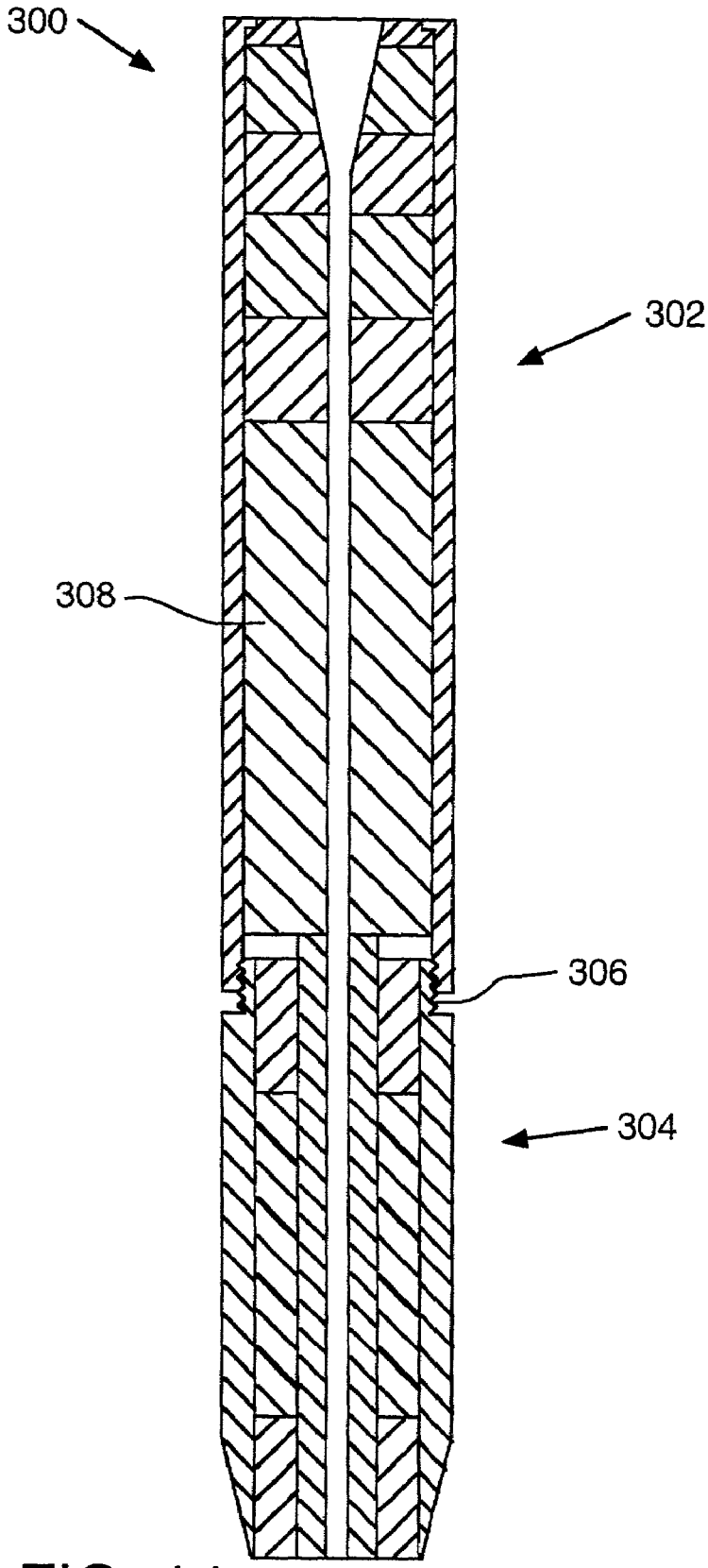
FIG. 14 is a longitudinal cross sectional view of an AWJ mixing tube prepared according to a tenth embodiment of the present invention.

FIG. 14 illustrates a tenth embodiment of an AWJ mixing tube according to the present invention. This embodiment illustrates the use of an abrasive resistant material other than a superhard material lining the bore in an intermediate region of the flow passage of the AWJ mixing tube. Referring to FIG. 14, AWJ mixing tube 300 comprises top section 302 which is disconnectably connected to bottom section 304 at threaded joint 306. Comparing to FIGS. 13 and 14, it can be seen that AWJ mixing tube 300 is the same as AWJ mixing tube 200, except that superhard material disks 216-224 of AWJ mixing tube 200 have been replaced with abrasion-resistant material cylinder 308 which is a non-superhard material. Although, the present invention contemplates that any portion of AWJ mixing tube flow passage can be lined with an abrasion-resistant material that is not a superhard material so long as at least the portion of the flow passage that is of particular concern to the user is lined with a superhard material, in terms of maximizing the working life of the AWJ mixing tube, it is preferred that the use of abrasion-resistant materials which are not superhard materials be confined to the flow passage region wherein the abrasive particles flow in a columnated stream, since such a region is less subject to abrasive wear during the operation of the AWJ mixing tube than are regions in which the particle flow is not in a columnated stream.

The present invention also includes among its embodiments all AWJ mixing tubes having superhard material lining the longitudinal bore of the AWJ mixing tube. Preferably, at least 0.005 inches (0.13 mm), and more preferably at least 0.010 inches (0.25 mm), of superhard material lining thickness surrounds the AWJ mixing tube longitudinal bore in these embodiments.

The present invention also includes among its embodiments AWJ systems having a mixing tube comprising a superhard material. Such embodiments include AWJ systems having an AWJ mixing tube which includes a flow passage formed by EDM in at least one abrasion-resistant material wherein at least part of the flow passage has a lining comprising a superhard material. These AWJ systems include those AWJ systems having AWJ mixing tubes which comprise a plurality of components and at least one connection, which may be a disconnectable connection, connecting one component to another such that the flow passages of each of the individual components communicate with each other to form the flow passage of the AWJ mixing tube and wherein the flow passage of at least one of the plurality of components has a lining comprising a superhard material. Such AWJ systems may include a booster pump, filter, intensifier pump, high pressure pumping, AWJ machining head, AWJ machining head moving mechanism, and collection tank such as those depicted in the prior art system illustrated in FIG. 1.

AWJ systems of the present invention having a mixing tube comprising a superhard material use any type of abrasive particles including, without limitation garnet, olivine, alumina, cubic boron nitride, zirconia, silicon carbide, boron carbide, diamond, and other minerals and ceramics and their mixtures and combinations. Preferably, such AWJ systems use abrasive particles having a hardness greater than garnet, for example, alumina, cubic boron nitride, diamond or their combinations with each other and other materials and their mixtures and combinations. Where abrasive particles such as diamond are used, the diamond particles may be recovered from the collection tank, cleaned and re-used where cost effective.

The present invention includes methods of using an AWJ system comprising the steps of (1) providing an AWJ mixing tube having a flow passage formed by EDM in at least one abrasion-resistant material wherein at least part of the flow passage has a lining comprising a superhard material; (2) providing abrasive particles; (3) emitting the abrasive particles from. the AWJ mixing tube; and (4) machining a workpiece with the emitted abrasive particles. Such a provided AWJ mixing tube may comprise a plurality of components and at least one connection, which may be a disconnectable connection, connecting one component to another such that the flow passages of each of the individual components communicate with each other to form the flow passage of the AWJ mixing tube and wherein the flow passage of least one of the plurality of components has a lining comprising a superhard material. For example without limitation, the present invention also includes among its embodiments methods of using an AWJ system comprising the steps of providing an abrasive water jet mixing tube having a longitudinal bore lined with a superhard material, providing abrasive particles, emitting the abrasive particles from the abrasive water Jet mixing tube, and machining a workpiece with the emitted abrasive particles. Such methods may include the step of selecting the abrasive particles from the group consisting of cubic boron nitride, diamond, their combinations with each other and other materials. Where abrasive particles are so selected from this group, the methods of the present invention include machining any type of workpiece, including workpieces comprising, in whole or in part, a material having a hardness of about 9 or greater on the Mohs scale. Note that all references herein to the Mohs scale are to the original Mohs hardness scale on which diamond has a Mohs hardness of 10. Examples of materials having a hardness of about 9 or greater include, without limitation diamond and cubic boron nitride.

The present invention contemplates that the durable material be any material that is capable of being bonded to superhard material or of acting to reduce the susceptibility of the AWJ mixing tube to damage from external forces or to facilitate the adaption of the superhard material core lining into the AWJ machining head. Preferably, the durable material also is capable of reinforcing the superhard material so as to prevent the AWJ mixing tube from being damaged by water jet back pressure should the AWJ mixing tube become plugged during operation. Examples of such materials, include without limitation, steels, cemented tungsten carbides, ceramics and cermets. However, in AWJ mixing tube designs in which the durable material is exposed to erosive wear from the high velocity water jet and abrasive particles during the AWJ operation, such as in designs in which a portion of the durable material is exposed as part of the tapered entryway of the AWJ mixing tube, the durable material is preferably a steel or a cemented tungsten carbide. Preferred steels include abrasive resistant alloy or tool steels such as steel grades 4140, 4340, H13, and A8. Preferred cemented tungsten carbide grades include those grades which contain approximately 0 to 20 weight percent binder (e.g. cobalt or cobalt-nickel alloys), more preferably approximately 6 to 16 weight percent binder.

The present invention contemplates that the bonding material be any bonding material that is capable of bonding superhard material to the particular type durable material that is being utilized during the practice of the invention. Although for convenience sake in the accompanying drawings, the bonding material has been represented in the form of thin strips, the present invention also contemplates using bonding material in any form that facilitates the bonding of the superhard material and the durable material bodies. Furthermore, although the methods described herein have described the bonding material as being assembled with the durable material and superhard material bodies into an assembly, the present invention also contemplates the addition of bonding material by any means that results in the durable material and superhard material bodies being bonded together into an AWJ mixing tube blank. For example, the present invention includes assembling the durable material and superhard material bodies into an assembly and then infiltrating the assembly with a fluid bonding material. Examples of suitable bonding materials include brazes and adhesives. When a cemented tungsten carbide is used as the durable material, the bonding material is preferably a brazing alloy. An example of a suitable brazing alloy is a brazing alloy having a liquidus of 606 C and containing 15% copper, 16% zinc, 45% silver, and 24% cadmium such as Easy-Flo 45 which is available from Handy & Harman of Canada, Limited, 290 Carlingview Drive, Rexdale, Ontario, Canada M9W5G1. When a steel is used as the durable material, the bonding material is preferably an adhesive. An example of suitable adhesive is a two-part, room temperature curable organic adhesive such as Aremco-Bond(TM) 631 which is available from Aremco Products, Inc. P.O. Box 429, Ossining, N.Y., 10562.

Commercially available PCD is suitable for use with the present invention. PCD is commercially available in the form of sheets and disks in thicknesses up to about 0.2 inches (5 mm) Disks of PCD are commercially available in diameters up to about 3 inches (78 mm). PCD is commercially available in a variety of grain sizes and with metallic contents of about 4 to 8 volume percent. This metallic content may include, for example, without limitation, cobalt or cobalt-nickel alloys. The average PCD grain size may be on the order of 0.1 to 100 micrometers. Examples of currently commercially available PCD grades have nominal average grain sizes of about 2, 10, 25, and 75 micrometers. PCD that is suitable for use with the present invention is available from Diamond Abrasives Corp, 35 West 45th Street, New York, New York 10036, and from General Electric, 6325 Huntley Road, Box 568, Worthington, Massachusetts 43085.

The present invention contemplates abrasion-resistant material to include superhard materials, as defined herein, as well as lower cost materials known to one skilled in the art that are capable of substantially resisting abrasion by the abrasive particles that are to be used in conjunction with the AWJ mixing tube. For example without limitation, such lower cost abrasion-resistant materials include cemented tungsten carbide or tool steel. Preferred cemented tungsten carbide grades include those grades which contain approximately 0 to 10 weight percent binder (e.g. cobalt or cobalt-nickel alloys), more preferably approximately 0 to 3 weight percent binder. For example, ROCTEC 100 and ROCTEC 500 are available from Kennametal Inc., of Latrobe, Pa. 15650. Preferred steels include abrasion resistant alloy or tool steels such as steel grades 4140, 4340, H13, and A8.

The present invention contemplates that materials that are suitable for the jackets include steel, aluminum, plastics and other materials known to one skilled in the art that are adaptable for such a use. Preferably, the jacket material will be a strong, resilient material.

The present invention contemplates that materials which are suitable for the centering couplings include metals and plastics or any other suitable materials which are known to one skilled in the art as being adaptable for such a use. Preferably, the material will be a resilient material and is most preferably a low carbon steel.

The present invention contemplates that the spacing material may be a material such as a metal, a plastic, or a potting compound or any other materiala known to one skilled in the art that is capable of fixing the superhard material or other abrasion-resistant pieces which comprise the entryway and core of the AWJ mixing tube in place relative to the jacket. Preferably, the spacing material is a material which is able to flow between the disks and the jacket and then harden with low shrinkage. A nonlimiting example of such a spacing material is EP30 epoxy available from MasterBond Inc., 154 Hobart Street, Hackensack, New Jersey, U.S.A., 07601.

The present invention also contemplates that any type of a gasketing material or shims known to one skilled in the art may be used between the faces of adjacent superhard material disks to improve their mating or to protect the superhard material and abrasive resistant material pieces from damage during the press fitting operation. Such gasketing material and shims may be used alone or in combination with other gasketing material or shims. Nonlimiting examples of such gasketing materials include metallic gaskets. A nonlimiting example of a material suitable for such shims is soft copper. The thicknesses of the gasketing material and shims are preferably no greater than about 0.005 inches (0.13 mm).

Figure 15:
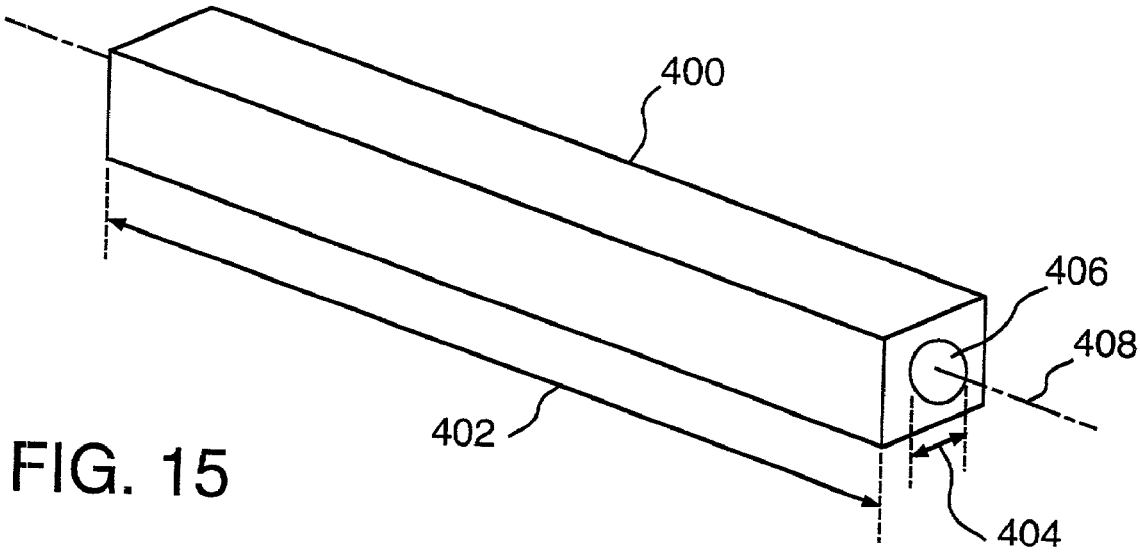
FIG. 15 is an isometric view of a tubular elongate superhard material body according to an embodiment of the present invention.

The present invention also comprises a tubular elongate superhard material body, and methods for making same, wherein the tubular elongate superhard material body has at least one bore formed by EDM which is substantially parallel to the longitudinal axis of the tubular elongate superhard material body. Such tubular elongate superhard material bodies have a ratio of bore length to bore diameter of from about 20 to about 400. The length of such a tubular elongate superhard material body is at least about 0.24 inches (6 mm) and is preferably about 1 inch (25 mm). Likewise, the bore length of such a tubular elongate body is at least about 0.24 inches (6 mm) and is preferably about 1 inch (25 mm). The bore diameter of such a tubular elongate superhard material body is preferably in the range of from about 0.005 to about 0.19 inches (0.13 to 4.8 mm) and more preferably in the range of from about 0.01 to about 0.065 inches (0.25 to 1.7 mm) . For example, referring to FIG. 15, tubular elongate superhard material body 400, has bore length 402 and bore diameter 404. Tubular elongate superhard material body 400 also has bore 406 formed by EDM. Bore 406 is substantially parallel to longitudinal axis 408 of tubular elongate superhard material body 400.

Such a tubular elongate superhard material may be made by first forming an elongate superhard material body and then forming at least one bore therein by EDM machining. Preferably, the elongate superhard material body is cut by EDM from a solid sheet or disk of PCD. Such a tubular elongate superhard material body may be used in an abrasive water jet mixing tube as described herein or may be used in any other application where a highly abrasion resistant passageway or conduit would be beneficial (e.g., sand blast, grin blast, or water blast nozzles; paint nozzles; and powder spray nozzles such as powder spray dryer nozzles).

The present invention also comprises superhard material cylinders having lengths of about 0.2 inches (5 mm) or more and diameters of about 0.2 inches (5 mm) or less and either a straight passage or a conical passage or a combination of a straight passage and a conical passage, along their longitudinal centerlines, formed by EDM machining. Such superhard material cylinders comprise a superhard material or a composite of a superhard material bonded to another abrasion-resistant material. Where a superhard material cylinder comprises a composite, preferably the non-superhard material abrasion-resistant material consists of tungsten carbide.

Figure 16A:
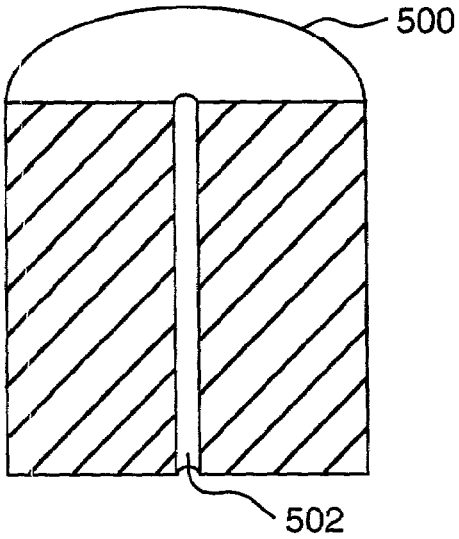
FIG. 16A is an isometric longitudinal cross sectional view across the midsection of a first embodiment of a superhard material cylinder according to the present invention.
Figure 16B:
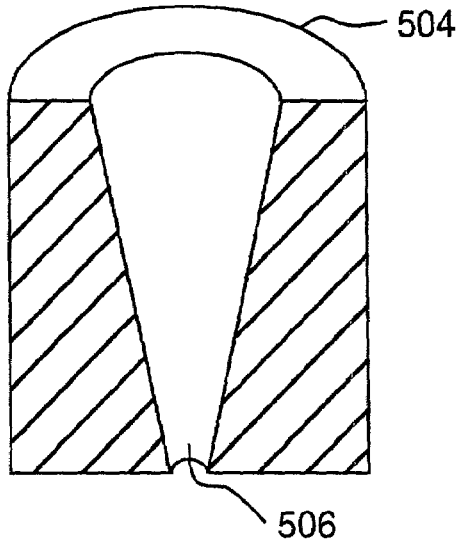
FIG. 16B is an isometric longitudinal cross sectional view across the midsection of a second embodiment of a superhard material cylinder according to the present invention.
Figure 16C:
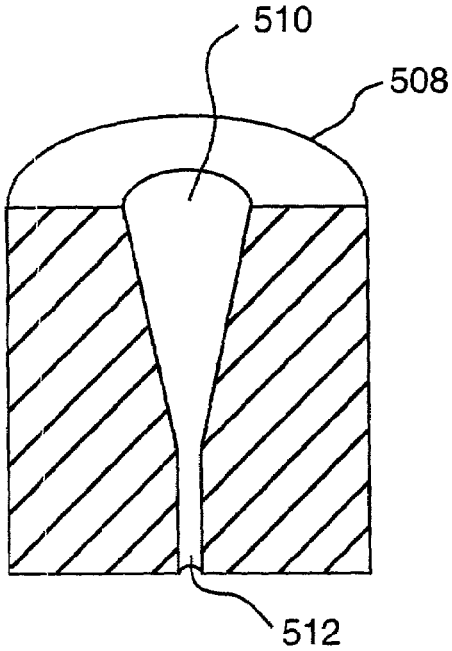
FIG. 16C is an isometric longitudinal cross sectional view across the midsection of a third embodiment of a superhard material cylinder according to the present invention.
Figure 16D:
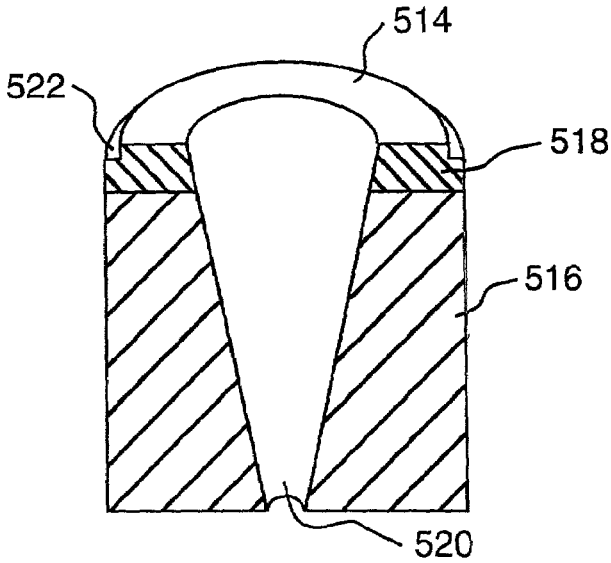
FIG. 16D is an isometric longitudinal cross sectional view across the midsection of a fourth embodiment of a superhard material cylinder according to the present invention.

An embodiment of a superhard material cylinder, first superhard cylinder 500, having a straight passage, first straight passage 502 is shown in FIG. 16A. An embodiment of a superhard material cylinder, second superhard material cylinder 504, having a conical section, first conical section 506, is shown in FIG. 16B. An embodiment of a superhard material cylinder, third superhard material cylinder 508, having a combination of a conical section, second conical section 510, and a straight section, second straight section 512, is shown in FIG. 16C. An embodiment of a superhard material cylinder, composite cylinder 514, comprising a composite of superhard material 516 and another abrasion-resistant material 518, having a conical section, third conical section 520 is shown in FIG. 16D. Composite cylinder 514 preferably includes recess 522 for receiving a shoulder of a jacket, such as upper section jacket shoulder 234 which is best seen in FIG. 13.

Where such a superhard material cylinder contains a straight passage, either alone or in combination with a conical passage, preferably the aspect ratio of the cylinder length to the diameter of the passage is at least 3 to 1, and more preferably at least 6 to 1, and most preferably at least 10 to 1, as these aspect ratios make the superhard material cylinders particularly useful in abrasive fluid carrying applications, for example without limitation, as part of AWJ mixing tubes.

Such a superhard material cylinder may be made by first forming a cylindrical body and then EDM machining the desired passage or combination of passages therein. Preferably, the cylindrical body is cut by EDM from a solid sheet or disk of PCD. Such a superhard material cylinder may be used in an abrasive water jet mixing tube as described herein or may be used in any other application where a highly abrasion resistant passageway or conduit would be beneficial (e.g., sand blast, grit blast, or water blast nozzles; paint nozzles; and powder spray nozzles such as powder spray dryer nozzles).

The patents and documents referred to herein are hereby incorporated by reference.

Having described presently preferred embodiments of the present invention, it is to be understood that the present invention may be otherwise embodied within the scope of the appended claims. Thus, while only a few embodiments of the present invention have been shown and described, it will be obvious to those skilled in the art that many changes and modifications may be made thereunto without departing from the spirit and scope of the present invention as described in the appended claims.

What is claimed is:

1. An abrasive water jet mixing tube comprising a longitudinal bore lined along substantially its entire length with an uninterrupted piece of a monolithic superhard material, wherein said superhard material consists of at least one selected from the group consisting of polycrystalline diamond and polycrystalline cubic boron nitride and wherein neither of said polycrystalline diamond and said polycrystalline cubic boron nitride is chemical vapor deposited.

2. The abrasive water jet mixing tube of claim 1 further comprising a durable material surrounding the superhard material substantially along the length of the AWJ mixing tube.

3. The abrasive water jet mixing tube of claim 2 wherein the durable material comprises a steel.

4. The abrasive water jet mixing tube of claim 2 wherein the durable material comprises a cemented tungsten carbide.

5. The abrasive water jet mixing tube of claim 1 wherein the superhard material has a thickness of at least about 0.005 inches (0.13 mm).

6. The abrasive water jet mixing tube of claim 1 further comprising a tapered entryway connecting to the longitudinal bore.

7. The abrasive water jet mixing tube of claim 6 further comprising a vapor deposition-deposited hard coating on a surface of the tapered entryway.

8. The abrasive water jet mixing tube of claim 7 wherein the hard coating is selected from the group consisting of diamond, titanium nitride, titanium carbide, titanium carbonitride, titanium aluminum nitride, aluminum oxide, and their combinations.

9. The abrasive water jet mixing tube of claim 1 further comprising an entryway piece bonded to said uninterrupted piece, the entryway piece having a second superhard material formed on a tapered entryway, wherein said second superhard material consists of at least one selected from the group consisting of polycrystalline diamond and polycrystalline cubic boron nitride and wherein neither of said polycrystalline diamond and said polycrystalline cubic boron nitride is chemical vapor deposited and wherein said second superhard material and said superhard material of said uninterrupted piece may be the same or different from one another.

10. The abrasive water jet mixing tube of claim 9 wherein the second superhard material formed on the tapered entryway has a thickness of at least about 0.005 inches (0.13 mm).

11. The abrasive water jet mixing tube of claim 1 wherein the superhard material is polycrystalline diamond.

* * * * *